US007496324B2

(12) United States Patent
Sugiura et al.

(10) Patent No.: US 7,496,324 B2
(45) Date of Patent: Feb. 24, 2009

(54) LUBRICANT APPLYING UNIT AND IMAGE FORMING APPARATUS

(75) Inventors: Kenji Sugiura, Yokohama (JP); Takahiko Tokumasu, Atsugi (JP); Daichi Yamaguchi, Hino (JP); Takuya Seshita, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 86 days.

(21) Appl. No.: 11/259,031

(22) Filed: Oct. 27, 2005

(65) Prior Publication Data

US 2006/0133872 A1 Jun. 22, 2006

(30) Foreign Application Priority Data

Oct. 27, 2004 (JP) ..... 2004-312097
Feb. 17, 2005 (JP) ..... 2005-040420
May 31, 2005 (JP) ..... 2005-159781

(51) Int. Cl.
*G03G 21/00* (2006.01)

(52) U.S. Cl. ..... 399/346; 399/350

(58) Field of Classification Search ..... 399/346, 399/345, 347, 168, 350
See application file for complete search history.

(56) References Cited

U.S. PATENT DOCUMENTS 4,519,698 A * 5/1985 Kohyama et al. ..... 399/346
4,614,949 A 9/1986 Hakkaku et al.
5,040,206 A 8/1991 Tokumasu et al.
5,208,607 A 5/1993 Ohashi et al.
5,955,228 A 9/1999 Sakai et al.
6,060,205 A * 5/2000 Takeichi et al. ..... 399/346
6,366,751 B1 4/2002 Shakuto et al.
6,398,345 B1 6/2002 Sakai et al.
6,560,419 B2 5/2003 Sugiura
6,625,409 B2 9/2003 Shakuto et al.
6,654,579 B2 11/2003 Shakuto et al.
6,721,523 B2 4/2004 Sugiura et al.
6,751,427 B2 6/2004 Sugiura
7,209,699 B2 * 4/2007 Yamaguchi et al. ..... 399/346
2002/0076238 A1 * 6/2002 Itami et al. ..... 399/346

(Continued)

FOREIGN PATENT DOCUMENTS

JP 63-149668 6/1988

(Continued)

OTHER PUBLICATIONS

U.S. Appl. No. 10/686,563, filed Oct. 17, 2003, Tokumasu, et al.

(Continued)

*Primary Examiner*—David M Gray
*Assistant Examiner*—Erika J. Villaluna
(74) *Attorney, Agent, or Firm*—Oblon, Spivak, McClelland, Maier & Neustadt, P.C.

(57) ABSTRACT

A lubricant applying unit includes a lubricant applying member, and a leveling member for use in an image forming apparatus having a photosensitive member. The lubricant applying member applies lubricant on a surface of the photosensitive member, and the leveling member levels off the lubricant on the surface of the photosensitive member. The lubricant applying unit applies the lubricant with a predetermined amount on the surface of the photosensitive member. The photosensitive member includes polyarylate resin in a surface layer of the photosensitive member.

21 Claims, 11 Drawing Sheets

U.S. PATENT DOCUMENTS

| | | | |
|---|---|---|---|
| 2002/0081128 | A1 | 6/2002 | Shakuto et al. |
| 2002/0090229 | A1 | 7/2002 | Shakuto et al. |
| 2003/0039494 | A1 | 2/2003 | Shakuto et al. |
| 2004/0042823 | A1 | 3/2004 | Sugiura et al. |
| 2004/0213600 | A1 | 10/2004 | Watanabe et al. |
| 2005/0002701 | A1 | 1/2005 | Ikeguchi et al. |
| 2005/0058474 | A1 | 3/2005 | Watanabe et al. |

FOREIGN PATENT DOCUMENTS

| | | | |
|---|---|---|---|
| JP | 03-050562 | | 3/1991 |
| JP | 05-150564 | | 6/1993 |
| JP | 06-118681 | | 4/1994 |
| JP | 09-062163 | | 3/1997 |
| JP | 2000029239 A | * | 1/2000 |
| JP | 2000-075752 | | 3/2000 |
| JP | 2000-162881 | | 6/2000 |
| JP | 2000-338733 | | 12/2000 |
| JP | 2002-244485 | | 8/2002 |
| JP | 2002-278099 | | 9/2002 |
| JP | 2002341694 A | * | 11/2002 |
| JP | 2003-029443 | | 1/2003 |
| JP | 2003-149849 | | 5/2003 |
| JP | 2003-186221 | | 7/2003 |
| JP | 2003-330320 | | 11/2003 |
| JP | 2004-198662 | | 7/2004 |

OTHER PUBLICATIONS

U.S. Appl. No. 11/687,875, filed Mar. 19, 2007, Kojima, et al.
U.S. Appl. No. 11/692,498, filed Mar. 28, 2007, Yamaguchi et al.
U.S. Appl. No. 11/855,806, filed Sep. 14, 2007, Awamura et al.
U.S. Appl. No. 11/856,379, filed Sep. 17, 2007, Sawada et al.

* cited by examiner

| | |
|---|---|
| (1) |  |
| (2) |  |
| (3) |  |
| (4) |  |
| (5) |  |
| (6) |  |
| (7) |  |

| | |
|---|---|
| (8) |  |
| (9) |  |
| (10) |  |
| (11) |  |
| (12) |  |
| (13) |  |

| | |
|---|---|
| (14) |  |
| (15) |  |
| (16) |  |
| (17) |  |
| (18) |  |
| (19) |  |

| | |
|---|---|
| (20) |  |
| (21) |  |
| (22) |  |
| (23) |  |
| (24) |  |

LUBRICANT APPLYING UNIT AND IMAGE FORMING APPARATUS

TECHNICAL FIELD

The present disclosure generally relates to an image forming apparatus using electro-photography such as a copier, printer, or facsimile, and more specifically, to a charging process of the image forming apparatus and lubricant applying unit for a photosensitive member.

BACKGROUND

Electro-photography is a method to form an electrostatic latent image on a photosensitive member using a photoconduction effect, and to adhere charged color particles (i.e., toners) on the electrostatic latent image with an electrostatic force so that an image can be produced.

Such image forming apparatus using electro-photography includes main components such as photosensitive member and intermediate transfer belt, wherein the photosensitive member or intermediate transfer belt is applied with a lubricant such as a wax, a fluorine resin (e.g., polytetrafluoroethylene, polyvinylidene fluoride), or a higher fatty acid metal salt (e.g., zinc stearate).

When a cleaning process for removing toners remaining on the photosensitive member or intermediate transfer belt is conducted by using a removing member such as a cleaning brush and cleaning blade, the above-mentioned lubricant, applied to the photosensitive member and intermediate transfer belt, can make effects in the following manner.

One of the effects of the lubricant is to improve the operating lifetime of the photosensitive member or intermediate transfer belt.

It has been known that a lifetime of photosensitive member or intermediate transfer belt is mainly affected by mechanical friction caused between the photosensitive member (or intermediate transfer belt) and the cleaning brush (or cleaning blade).

Accordingly, lubricant is applied on a surface of the photosensitive member or intermediate transfer belt to reduce the friction coefficient of the surface of the photosensitive member or intermediate transfer belt, and consequently to reduce abrasion on the photosensitive member or intermediate transfer belt.

Another effect of the lubricant is to improve cleaning-ability.

By applying lubricant to the surface of the photosensitive member or intermediate transfer belt, the friction coefficient of the surface of the photosensitive member and intermediate transfer belt can be reduced, thereby deposits adhered on the surface of the photosensitive member or intermediate transfer belt can be easily removed from the surface of the photosensitive member or intermediate transfer belt.

Accordingly, toners remaining on the photosensitive member or intermediate transfer belt can be easily removed after transferring toner images to a recording medium such as paper.

In recent years, spherical toners prepared by a polymerization method have been used for image forming apparatus. Such spherical toners have properties such as uniform particle size and smaller diameter, which is favorable to improve image quality.

However, such properties may cause difficulties on cleaning of toners from a photosensitive member. Under such conditions, lubricant can be used to improve cleaning-ability on the photosensitive member.

Such lubricant may be supplied to a surface of the photosensitive member in a small amount in a form of powders.

Specifically, lubricant can be applied to the photosensitive member by scraping a block-shaped lubricant with an applying device such as a brush, or by attaching lubricant on toners, for example.

If the lubricant is supplied to the photosensitive member by attaching lubricant on the toners, the lubricant supplying amount depends on an image area (i.e., toner amount) to be produced. Thus the lubricant may not be constantly provided on an entire surface of the photosensitive member.

Accordingly, in order to supply lubricant stably on the entire surface of the photosensitive member with a simpler configuration, a combination of solid-type lubricant and a brush for scraping the lubricant is preferably used to apply the lubricant.

When applying the lubricant with such a configuration, several methods can be used to control the application conditions of the lubricant.

In one method, a lubricant biasing pressure condition to the photosensitive member or a rotating speed of the applying brush, contacting the solid-type lubricant, can be controlled based on temperature conditions.

In another method, the lubricant application amount can be controlled by considering the rotating speed of the photosensitive member.

In another method, the rotating speed of the applying brush can be controlled based on process information during the image forming process.

In another method, the lubricant application amount and charging voltage can be controlled based on an image concentration of image pattern formed on the photosensitive member.

In another method, the lubricant application amount can be controlled based on several conditions such as abrasion status of a cleaning blade, number of image forming process times, total traveling distance of the photosensitive member, and blade temperature, for example.

In an image forming process, the photosensitive member may encounter diverse hazards, whereby the lubricant applied on the photosensitive member may also encounter diverse hazards.

For example, a charging process, which is conducted before forming an electrostatic latent image on the surface of the photosensitive member, may cause hazards on the surface photosensitive member. Accordingly, the charging method used in an image forming apparatus may affect such hazards. Therefore, the lubricant application amount may need to be determined in consideration of such hazard effects to improve effectiveness of the lubricant.

As for conventional charging methods for image forming apparatus using electro-photography, a corona charging method, a contact charging method, or a proximity charging method can be used, for example.

In the corona charging method, a charge wire is disposed closely to the photosensitive member, and then a high voltage is applied to the charge wire to cause a corona discharge between the charge wire and the photosensitive member so that the photosensitive member can be charged.

In the contact charging method and the proximity charging method, a charge device (e.g., roller, brush, and blade) is disposed by contacting the charge device and the photosensitive member or by positioning the charge device closely to the photosensitive member, and then a voltage is applied to the charge device to charge the surface of the photosensitive member.

Accordingly, directly or via a narrow gap, the photosensitive member is charged by a discharge conducted by the charge device, thereby uneven discharging may happen and may cause non-uniform charging on the photosensitive member.

In view of such situations, a charging method may be used, in which an alternating current voltage (AC voltage) is superimposed to a direct current voltage (DC voltage), and such voltage is applied to the photosensitive member to charge the photosensitive member.

In general, compared to the corona charging method, the contact charging method or the proximity charging method may produce less by-products (e.g., ozone) generated by discharging, and can conduct charging with lower electric power.

However, compared to the corona charging method, the contact charging method or the proximity charging method may cause more hazards to the photosensitive member because the photosensitive member contacts a charging device directly.

Especially, if the AC voltage is superimposed, an effect of such hazards may become significant, thereby chemical properties of the surface of the photosensitive member may significantly deteriorate. Such chemical deterioration may further cause layer chipping of the photosensitive member.

Accordingly, chemical properties (e.g., molecular structure and surface energy) of the lubricant applied on the photosensitive member may be changed, and such changes may result into a loss of lubricating ability.

At the same time, the lubricant may be chipped gradually, and consequently may be chipped away completely. Therefore, chemical deterioration of the lubricant due to the charging process should be considered for determining lubricant application conditions.

Accordingly, even if an adequate amount of lubricant can be applied on the photosensitive member initially, the lubricant needs to be applied on the photosensitive member in a constant manner so that the lubricant can stably exert its function effectively over time.

Compared to the corona charging method, the contact charging method generates by-products such as ozone at a significantly low level.

In the corona charging method, approximately 80% of the electric current applied to the charging device is wasted because such electric current flows to a shield.

However, the contact charging method does not waste such amounts of electric current, thereby contact charging method is preferable in several aspects including economy of energy.

However, in the contact charging method, the charge device contacts the photosensitive member. Thus the photosensitive member needs higher mechanical strength.

In order to improve charging stability, an alternating current voltage (AC voltage) can be superimposed to a direct current voltage (DC voltage), and such voltage can be applied to the charge device, for example.

Although such voltage applied to the charge device can improve charging stability, the electric current amount flowing to photosensitive member increases significantly because the alternating current voltage (AC voltage) is superimposed.

As a result, the chipping amount of the photosensitive member may increase, chemical properties of the surface of the photosensitive member may deteriorate, and a cleaning unit may lower its cleaning-ability.

Therefore, methods to improve both mechanical strength and electrical strength of the photosensitive member have been proposed.

For example, a bisphenol Z-type polycarbonate resin can be used as a binder resin to form a surface of a photosensitive member to improve surface properties such as anti-abrasion property, and toner filming.

In another case, a curable silicone resin including colloidal silica is used as a surface protection layer of a photosensitive member to improve surface properties such as anti-abrasion property.

However, a bisphenol Z-type polycarbonate resin may not be able to provide sufficient anti-abrasion property to the photosensitive member, and may not exert enough durability to the photosensitive member.

The curable silicone resin including colloidal silica may improve anti-abrasion property of the photosensitive member, however, such curable silicone resin may not cope with some drawbacks on electro-photography property such as image fogging and image blurring when the photosensitive member is used repeatedly.

When manufacturing a photosensitive member, a leveling agent such as silicone oil can be added to a coating liquid to secure smoothness of the coated layer.

Generally, silicone oil can lower the friction coefficient between the photosensitive member and a cleaning blade.

However, the silicone oil (as leveling agent) may be distributed in a surface layer of the coated layer, thereby the silicone oil may lower friction coefficient of the surface layer temporarily, but may not be effective to lower friction coefficient of the surface layer over time.

If a large amount of silicone oil is added to the coating liquid to increase its effectiveness in lowering the friction coefficient, drawbacks such as poor coat-ability and image fogging due to an excessive distribution of the silicone oil in the surface layer of the photosensitive member may happen.

In another case, an image forming apparatus includes a photosensitive member having a surface layer formed with a polyarylate resin.

In such image forming apparatus, images having a higher image quality can be stably produced even if the photosensitive member is used repeatedly, and curling of a cleaning blade may be suppressed.

However, the surface of the photosensitive member is affected by discharging, thereby a cleaning deficiency may happen over time as similar to the use of a polycarbonate resin.

The polyarylate resin has properties such as higher shock resistance and elasticity, whereby the surface of the photosensitive member having polyarylate resin is less likely to be scratched when a cleaning operation is conducted on the photosensitive member. Thus a filming phenomenon originating from scratches may also be less likely to happen.

The polyarylate resin has another property such as environmental stability, such as lower hygroscopicity, whereby toners remaining on the photosensitive member can be cleaned effectively.

However, the surface of the photosensitive member having polyarylate resin is affected (i.e., deteriorated) by repeated image forming processes.

Such deterioration may happen because the photosensitive member is oxidized (i.e., deterioration) due to a discharge in the charging process.

That is, radical elements generated by discharge may change the molecular structure of the polyarylate resin from an original molecular structure (e.g., oxidization, smaller molecular weight), whereby the polyarylate resin may lower its original property such as cleaning-ability.

Such phenomenon is more likely to happen when charging is conducted with AC current.

If a lubricant layer is formed on the photosensitive member having the polyarylate resin, the polyarylate resin may not deteriorate by discharge.

However, if the applied lubricant amount is too large, the cleaning-ability of the surface of the photosensitive member may deteriorate. This may be caused by the presence of an excess amount of lubricant over the surface of the photosensitive member having polyarylate resin.

If the applied lubricant amount is too small, the lubricant layer is not formed effectively, whereby some surface area of the photosensitive member may be exposed to an external environment, and the photosensitive member may deteriorate from such surface area due to discharge.

Compared to a corona charging method, a roller charging, which is conducted using a direct discharge, may generate less harmful gas such as ozone, but the photosensitive member is likely to deteriorate.

If the charge device such as a roller contacts the photosensitive member, a lubricant layer may be peeled off from the photosensitive member from an area where the charge device contacts the photosensitive member, and the photosensitive member may deteriorate from such exposed area by discharge.

Furthermore, the surface of the photosensitive member may be abraded by a cleaning process. If such abrasion progresses rapidly, the surface of the photosensitive member may be abraded unevenly, whereby the lubricant may not be applied on the surface of the photosensitive member uniformly.

SUMMARY OF THE INVENTION

The present disclosure relates to a lubricant applying unit including a lubricant applying member, and a leveling member for use in an image forming apparatus having a photosensitive member. The lubricant applying member applies lubricant on a surface of the photosensitive member, and the leveling member levels off the lubricant on the surface of the photosensitive member. The lubricant applying unit applies the lubricant with a predetermined amount on the surface of the photosensitive member. The photosensitive member includes polyarylate resin in a surface layer of the photosensitive member.

BRIEF DESCRIPTION OF THE DRAWINGS

A more complete appreciation of the disclosure and many of the attendant advantages and features thereof can readily be obtained and understood from the following detailed description with reference to the accompanying drawings, wherein.

DETAILED DESCRIPTION OF PREFERRED EMBODIMENTS

Figure 1:
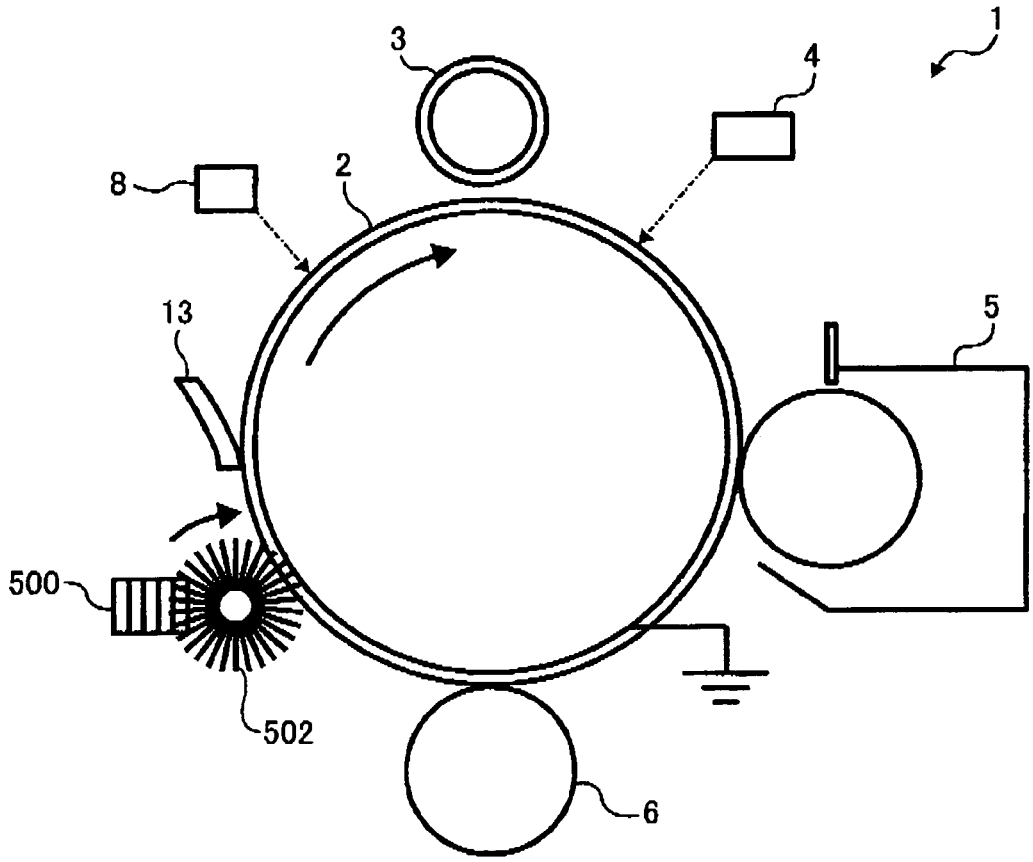
FIG. 1 is a schematic view explaining a configuration of an image forming apparatus according to one example embodiment.

In describing preferred embodiments shown in the drawings, specific terminology is employed for the sake of clarity. However, the disclosure of this present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus provided with a lubricant supplying system are described.

FIG. 1 is an image forming apparatus 1 according to one example embodiment.

As shown in FIG. 1, the image forming apparatus 1 includes a photosensitive member 2, a charging roller 3, an image writing unit 4, a developing unit 5, a transfer unit 6, a cleaning unit 13, a de-charging unit 8, a solid-type lubricant 500, and a fur brush 502.

The photosensitive member 2 rotates in an arrow direction as shown in FIG. 1.

The image forming apparatus 1 also includes a sheet feed cassette (not shown) to store a plurality of recording sheets, a sheet feed roller (not shown), and a pair of registration rollers (not shown).

The sheet feed roller (not shown) feeds the recording sheets one by one from the sheet feed cassette (not shown) to the pair of registration rollers (not shown), which adjust feed timing of the recording sheet to a nip space formed between the transfer unit 6 and the photosensitive member 2.

In the image forming apparatus 1, the photosensitive member 2 rotates in the arrow direction shown in FIG. 1, and the charging roller 3 charges a surface of the photosensitive member 2 uniformly.

Then, the image writing unit 4 irradiates laser beams, modulated based on corresponding image data, to the surface of the photosensitive member 2 to form an electrostatic latent image on the photosensitive member 2.

The developing unit 5 develops the electrostatic latent image as toner image on the photosensitive member 2 by supplying toners to the electrostatic latent image.

The transfer unit 6 transfers the toner image formed on the photosensitive member 2 to the recording sheet, which is fed to the nip space formed between the transfer unit 6 and the photosensitive member 2, and then the recording sheet is fed to a fixing unit (not shown) to fix the toner image on the recording sheet.

As above mentioned, the recording sheet is fed to the nip space formed between the transfer unit 6 and the photosensitive member 2 by the pair of registration rollers (not shown) which adjusts feed timing of the recording sheet.

The fixing unit (not shown) includes a fixing roller (not shown) and a pressure roller (not shown), wherein the fixing roller (not shown) is heated to a predetermined fixing temperature by a heater provided therein, and the pressure roller (not shown) is pressed toward the fixing roller (not shown) with a predetermined pressure.

The fixing unit (not shown) applies heat and pressure to the recording sheet, transported from the nip space, to fix the toner image on the recording sheet. Then, the recording sheet is ejected to a sheet ejection tray (not shown).

After transferring the toner image to the recording sheet at the nip space formed between the transfer unit 6 and the photosensitive member 2, the photosensitive member 2 rotates in the arrow direction shown in FIG. 1.

During such rotation, the cleaning unit 13 removes toners remaining on the surface of the photosensitive member 2 with a blade, and the de-charging unit 8 de-charges the photosensitive member 2.

After de-charging the photosensitive member 2, the charging unit 3 can charge the photosensitive member 2 uniformly for a next image forming process, which is similarly conducted as in the above-mentioned image forming processes.

The cleaning unit 13 can also include a fur brush to remove toners remaining on the photosensitive member 2 instead of the above-mentioned blade.

Figure 2A:
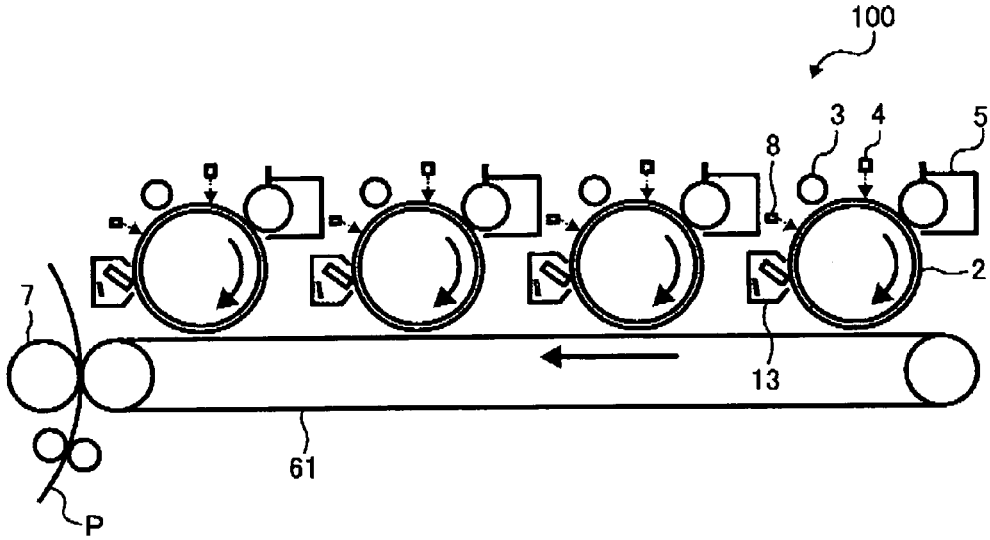
FIG. 2A is a schematic view explaining an image forming apparatus of tandem type.
Figure 2B:
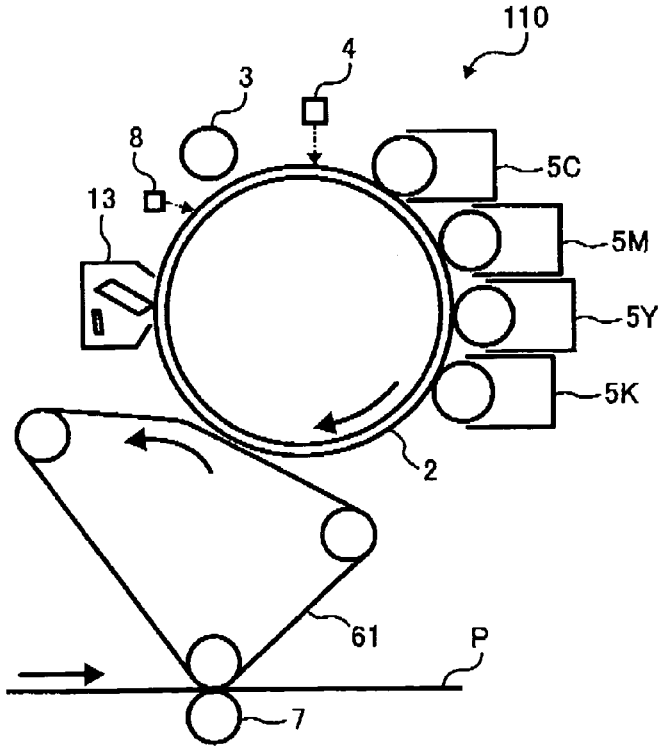
FIG. 2B is a schematic view explaining an image forming apparatus of revolver type.

FIGS. 2A and 2B are schematic views of another image forming apparatuses according to one example embodiment.

FIG. 2A is a schematic view of an image forming apparatus of tandem type, and FIG. 2B is a schematic view of an image forming apparatus of revolver type.

As shown in FIGS. 2A and 2B, each of the image forming apparatuses 100 and 110 includes the photosensitive member 2 rotating in an arrow direction, the charging unit 3, the image writing unit 4, the developing unit 5, an intermediate transfer member 61, and an image transfer unit 7.

The image forming apparatus 1 also includes a sheet feed cassette (not shown) to store a plurality of recording sheets P, a sheet feed roller (not shown), and a pair of registration rollers (not shown).

The sheet feed roller (not shown) feeds recording sheets P one by one from the sheet feed cassette (not shown) to the pair of registration rollers (not shown), which adjust feed timing of the recording sheet to a nip space formed between the intermediate transfer member 61 and the image transfer unit 7.

The photosensitive member 2 rotates in the arrow direction shown in FIGS. 2A and 2B, and the charging roller 3 charges a surface of the photosensitive member 2 uniformly.

Then, the image writing unit 4 irradiates laser beams, modulated based on corresponding image data, to the surface of the photosensitive member 2 to form an electrostatic latent image on the photosensitive member 2.

The developing unit 5 develops the electrostatic latent image as toner image on the photosensitive member 2 by supplying toners to the electrostatic latent image.

The toner image formed on the photosensitive member 2 is then transferred to the intermediate transfer member 61. Such image transfer process is conducted for each of the colors of cyan, magenta, yellow, and black (i.e., CMYK) to form a color toner image on the intermediate transfer member 61.

In the image forming apparatus 110 of revolver type shown in FIG. 2B, a plurality of color toner images are formed on one photosensitive member 2 by sequentially operating developing units 5C, 5M, 5Y, and 5K one by one in the desired order.

Such plurality of color toner images are transferred from the photosensitive member 2 to the intermediate transfer member 61, and further transferred to the recording sheet P, which is fed to a nip space formed between the image transfer unit 7 and the intermediate transfer member 61.

The recording sheet P is then transported to a fixing unit (not shown) to fix the toner image on the recording sheet P.

After transferring the toner image to the intermediate transfer member 61, the photosensitive member 2 rotates in the arrow direction shown in FIGS. 2A and 2B.

During such rotation, the cleaning unit 13 removes toners remaining on the surface of the photosensitive member 2 with a blade, and the de-charging unit 8 de-charges the photosensitive member 2.

After de-charging the photosensitive member 2, the charging unit 3 can charge the photosensitive member 2 uniformly for a next image forming processes, which is similarly conducted as in the above-mentioned image forming processes.

The cleaning unit 13 can also include a fur brush to remove toners remaining on the photosensitive member 2 instead of the above-mentioned blade.

Hereinafter, the charging unit 3 is explained with reference to FIG. 3.

Figure 3:
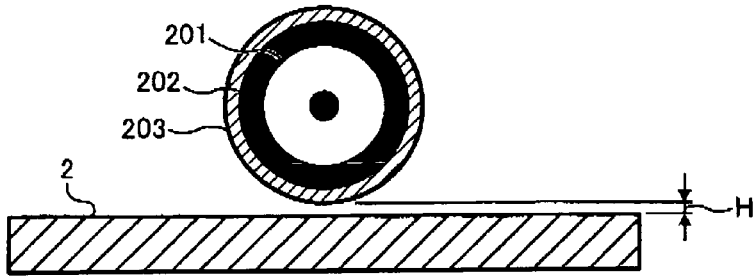
FIG. 3 is a schematic view explaining a charging roller according to one example embodiment.

As shown in FIG. 3, the charging unit 3 is deposited above the photosensitive member 2 with setting a gap H between the charging unit 3 and the photosensitive member 2.

The charging unit 3 is a hard type electro-conductive roller, which includes an electro-conductive core material 201 and a resistive layer 202 provided on the electro-conductive core material 201, and a top thin layer 203 on the resistive layer 202, for example.

The electro-conductive core material 201 can be made of stainless steel cylinder having a diameter of 5 to 20 mm, for example.

The electro-conductive core material 201 can also be made of materials such as aluminum, and electro-conductive resin, having a resistance value of $10^2$ Ω·cm or less, to reduce the weight of electro-conductive core material 201, for example.

The resistive layer 202 can be made of polymer materials such as mixture of an electro-conductive material and acrylonitrile-butadiene-styrene resin (ABS resin). The electro-conductive material includes metal ion complex, carbon black, ionic molecular compound, for example. The electroconductive material also includes a material, which can conduct uniform charging.

The top thin layer 203 can be made of fluorine resin, for example.

The charging roller 3 may rotate with the photosensitive member 2, or may not rotate with the photosensitive member 2.

The charging roller 3 has a longitudinal length, which is larger than a maximum width of to-be-produced image. If the to-be-produced image is an A4 size, the longitudinal length of the charging roller 3 may be slightly larger than a maximum width of A4 size (approximately 290 mm), for example.

Figure 4:
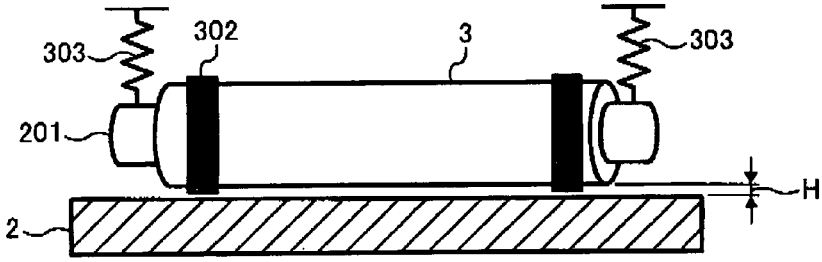
FIG. 4 is a schematic view explaining how to maintain a gap between a charging roller and a photosensitive member.

As shown in FIG. 4, the charging roller 3 is provided with a spacer member at each longitudinal end portion of the charging roller 3.

Each of the spacer members contacts the end portion of the photosensitive member 2, which is not used for image forming process so that the gap H is maintained between the surface of the photosensitive member 2 and the surface of the charging roller 3.

The gap H can be maintained in a range of 5 to 100 μm, and more preferably to a range of 30 to 65 μm. Therefore, the gap H can be set to 55 μm in one example embodiment.

The charging roller 3 is connected to a power source (not shown), which is used to charge the charging roller 3.

Then, the charging roller 3 charges the surface of the photosensitive member 2 uniformly by discharging charges between the gap H.

Bias voltage can be applied by superimposing AC voltage to DC voltage, wherein it is preferable that a voltage value between peaks (i.e., mountain and valley) of AC voltage is set larger than a charging initiation voltage by twice the charging initiation voltage or more.

The bias voltage may be DC voltage, as required, or preferably be a constant-current voltage.

FIG. 4 is a schematic view explaining how to maintain the gap H between the charging roller 3 and the photosensitive member 2.

In FIG. 4, a film is rolled on the both end portions of the charging roller 2 to form a spacer 302 on the both end portions of the charging roller 2.

The spacer 302 contacts the surface of the photosensitive member 2 to secure the gap H between the charging roller 3 and the photosensitive member 2.

A bias voltage having superimposed AC voltage is applied to conduct a discharging between the gap H of the charging roller 3 and photosensitive member 2 to charge the photosensitive member 2.

Furthermore, a shaft of the charging roller 3 can be biased by a spring 303 as shown in FIG. 4 so that the gap H can be maintained more precisely. The spring 303 preferably biases the charging roller 3 to the photosensitive member 2 with a biasing pressure of 4 to 25 N, for example.

Furthermore, the spacer 302 can be integrally formed with the charging roller 3, wherein the surface of the spacer 302 is formed with insulating material in this case.

By using the insulating material to the spacer 302, discharging may not happen between the spacer 302 and the photosensitive member 2, whereby deposits that may be generated by discharging may not accumulate or adhere on the spacer 302. Accordingly, the gap H may be maintained in a predetermined distance.

The spacer 302 is preferably made of heat shrinkable tube, for example.

The heat shrinkable tube includes a product "F105" (a product of Sumitomo Chemical Co., Ltd.) having a thickness of 300 μm and used by applying 105 Celsius degrees, for example.

Because the heat shrinkable tube has a shrinking rate of 50 to 60%, the heat shrinkable tube increases its thickness for about 0 to 200 μm, whereby a consideration is required to cutting work of the charging unit 3 to accommodate such thickness increase.

For example, if a spacer member is attached to charging unit 3 having a diameter of 12 mm, the cutting depth of the charging unit 3 may be to 350 μm, and a heat shrinkable tube having an inner diameter of about 15 mm can be used.

After attaching the heat shrinkable tube to the end portion of the charging unit 3 having a cut area, the heat shrinkable tube can be heated with a heat source of 120 to 130 Celsius degrees while rotating the charging unit 3 to conduct heat shrinking uniformly. With such heating method, the gap H between the charging unit 3 and the photosensitive member 2 can be set to approximately 50 μm, for example.

Although the heat shrinkable tube fixed by such heating method may not slip off from the charging unit 3, liquid type adhesives such as cyanoacrylate resin (e.g., Aron Alpha®, cyanobond) can be applied on the end portion of the charging unit 3 to fix the heat shrinkable tube more securely.

Because the heat shrinkable tube has some thickness, the heat shrinkable tube can be attached as the spacer member 302 to the charging unit 3 as below.

Figure 5:
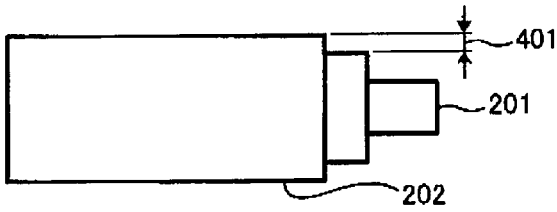
FIG. 5 is a schematic view explaining a step provided on a charging roller to attach a spacer member on the charging roller.

For example, as shown in FIG. 5, a step 401 can be formed in the charging unit 3 to attach the spacer 302.

Figure 6:
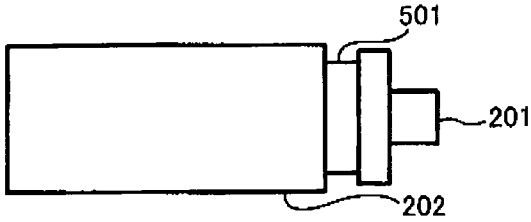
FIG. 6 is a schematic view explaining a groove formed on an end portion of a resistive layer to attach a spacer member having square shape in cross section.

For another example, as shown in FIG. 6, a groove 501 is formed in the charging unit 3 to attach the spacer 302 having square shape in cross section.

Figure 7:
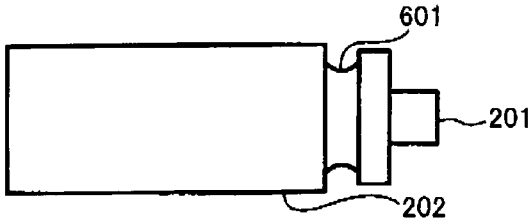
FIG. 7 is a schematic view explaining a rounded groove on an end portion of a resistive layer to attach a spacer member having rounded shape in cross section.

For another example, as shown in FIG. 7, a groove 601 having a rounded portion can be formed in the charging unit 3 to attach the spacer 302 having rounded shape in cross section (e.g., O-ring shape).

It is preferable to partially cut the end portion of the charging unit 3 so that the spacer 302 can be easily inserted, or to entirely cut the end portion of the charging unit 3 to fix the spacer 302 with adhesives.

When the spacer 302 is attached and fixed to the cut area or the groove, it is preferable to use adhesives such as the above-mentioned liquid type adhesives, and a two-liquid type epoxy resin, for example.

Figure 17:
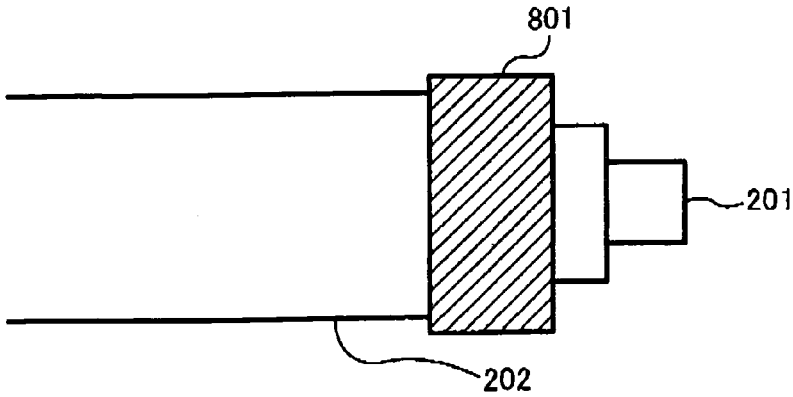
FIG. 17 is a schematic view explaining a charging roller fitted with a roller member having a diameter lager than a charging roller.
Figure 18A:
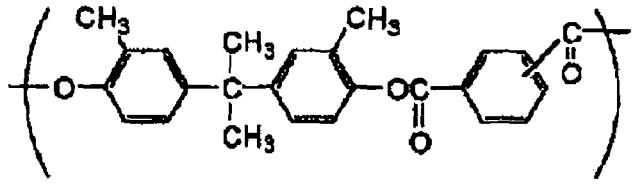
FIGS. 18A to 18D show polyarylate resins used for a photosensitive member.
Figure 18A:
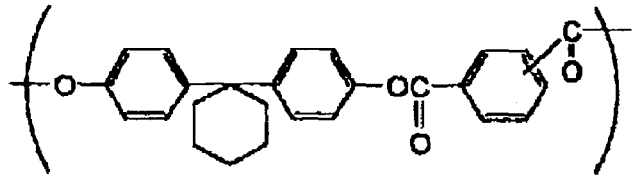
Figure 18A:
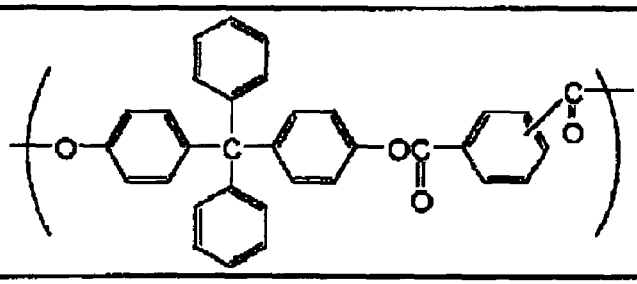
Figure 18A:
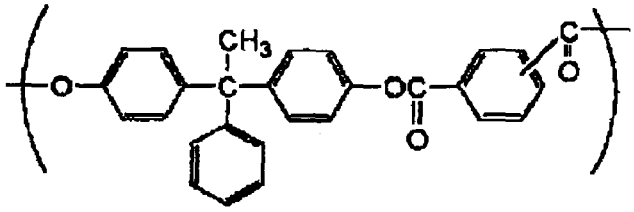
Figure 18A:
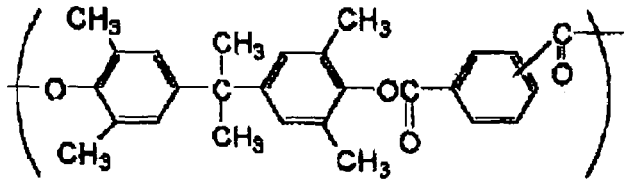
Figure 18A:
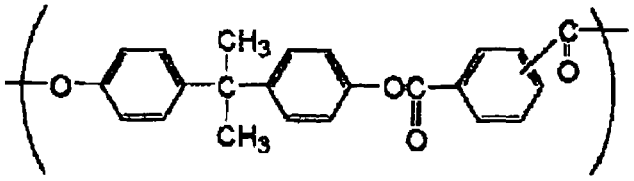
Figure 18A:
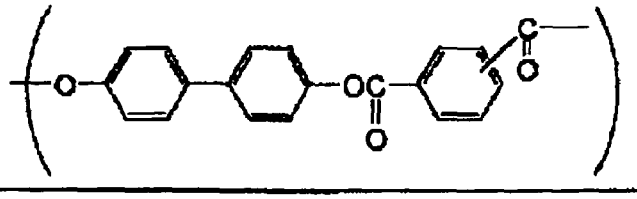
Figure 18B:
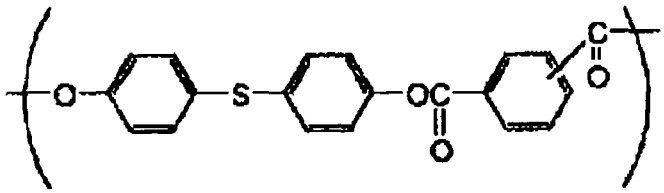
Figure 18B:
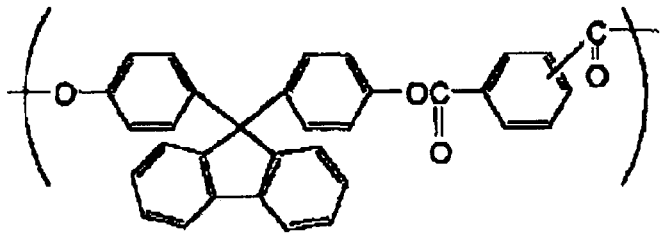
Figure 18B:
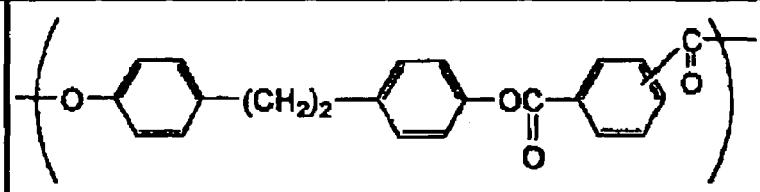
Figure 18B:
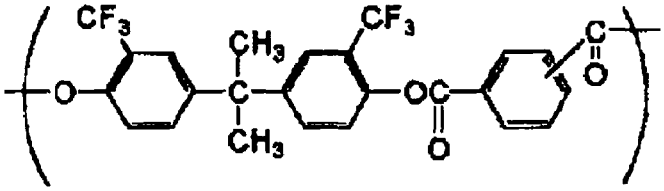
Figure 18B:
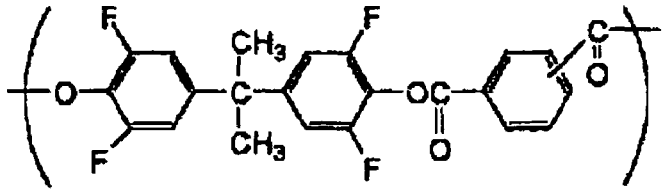
Figure 18B:
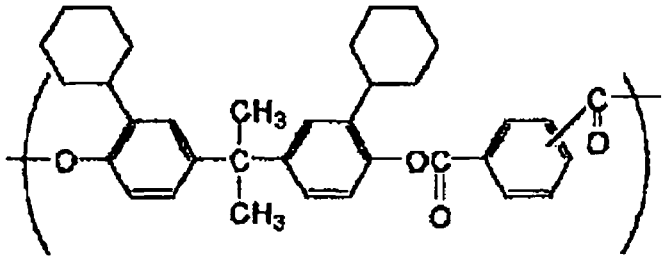
Figure 18C:
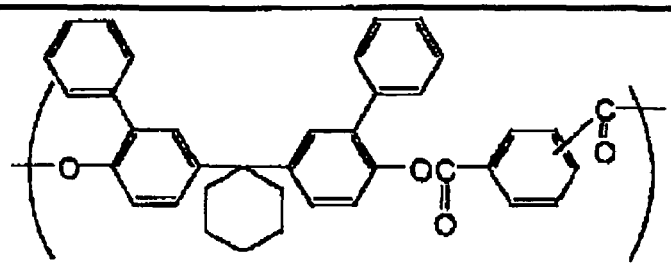
Figure 18C:
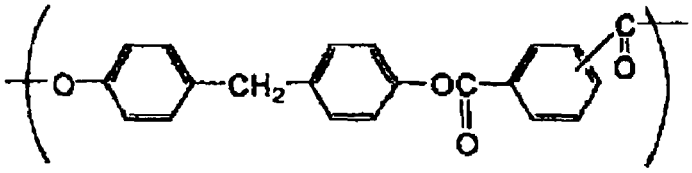
Figure 18C:
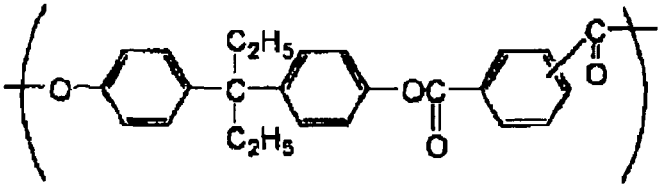
Figure 18C:
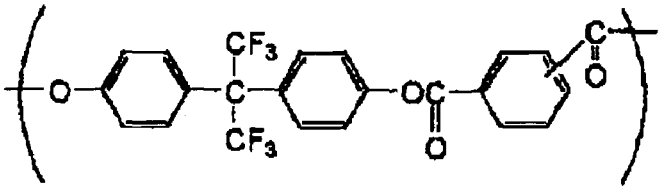
Figure 18C:
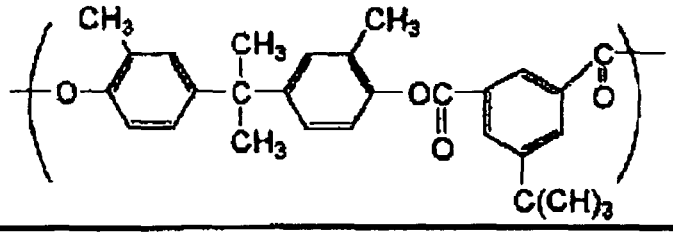
Figure 18C:
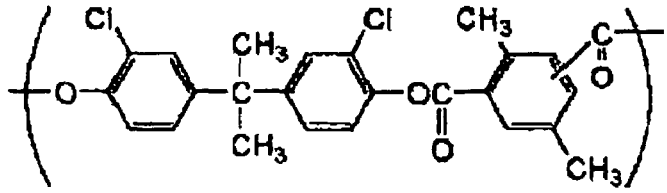
Figure 18D:
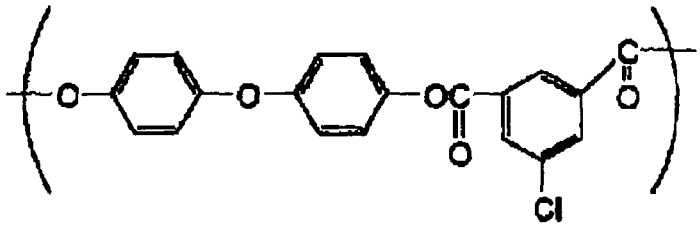
Figure 18D:
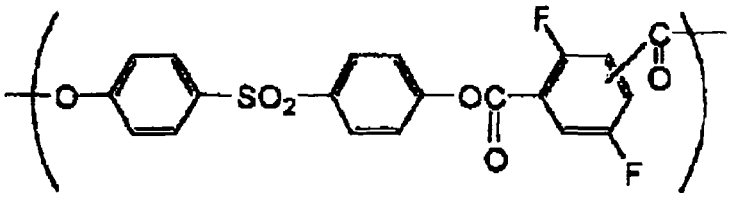
Figure 18D:
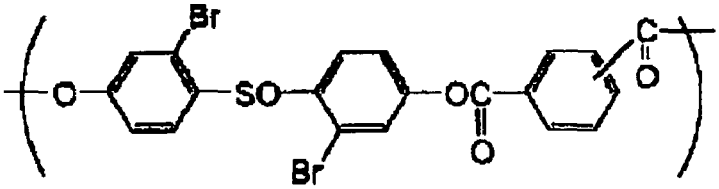
Figure 18D:
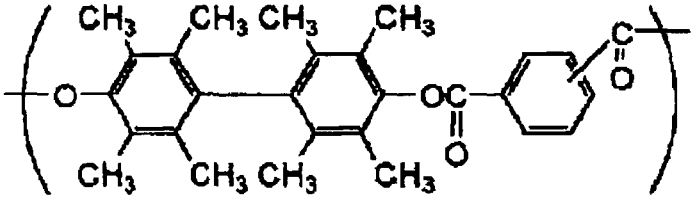
Figure 18D:
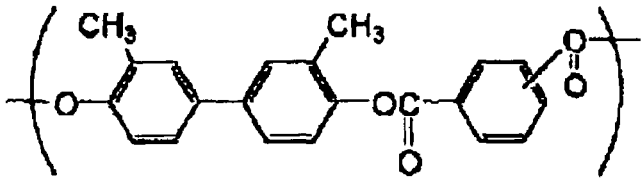

Furthermore, a spacer member can be formed by inserting a member having a diameter larger than the charging unit 3 as shown in FIG. 17.

The spacer member can be made of materials such as polycarbonate (PC), polyacetal (POM), polypropylene (PP), polyethylene (PE), ultrahigh molecular weight polyethylene (UHMW-PE), polyamide 6 (PA6), polyamide 66 (PA66), modified polyphenylene ether (m-PPE), acrylonitrile-butadiene-styrene (ABS), polyarylate (PAR), poly-tetrafluoroethylene (PTFE), phenolic resin, bakelite, Teflon (registered trademark), polysulfone (PSF), polyethersulfone (PES), polyphenylene sulfide (PPS), polyarylate (PAR), polyamide-imide (PAI), polyetherimide (PEI), polyetheretherketone (PEEK), thermoplastic polyimide (TPI), polybenzimidazole (PBI), polymethylpentene (TPX), polycyclohexylene·dimethylene·terephthalate (PCT), syndiotactic polystyrene (SPS), polyamide 6T (PA6T), polyamide 9T (PA9T), polyamide 11, 12 (PA11, 12), and fluorine resin, for example.

The roller member includes a mixture of the above-mentioned resins, or a mixture of same type resin by differentiating grades of the same type resin.

FIGS. 8A to 8D are schematic views explaining amorphous silicon layer construction of a photosensitive member.

Figure 8A:
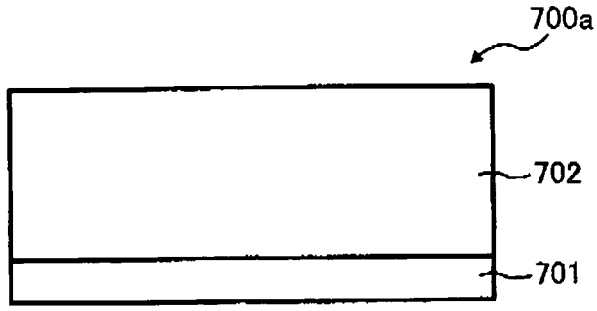
FIGS. 8A to 8D are schematic views explaining amorphous silicon layer construction of a photosensitive member.

FIG. 8A shows a photosensitive member 700*a*, which includes a support member 701, and a photosensitive layer 702, wherein the photosensitive layer 702 is formed of amorphous hydrogenated silicon or amorphous halogenated silicon (a-Si:H, X) and has photoconductivity property.

Figure 8B:
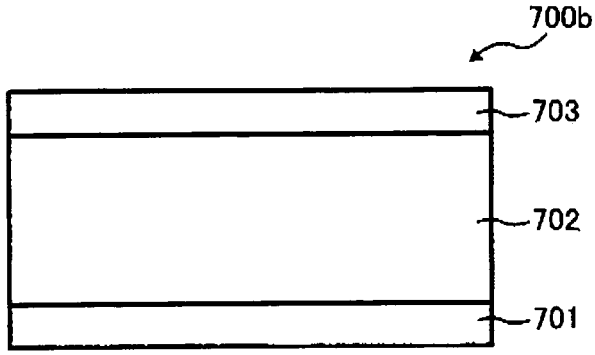

FIG. 8B shows a photosensitive member 700*b*, which includes the support member 701, the photosensitive layer 702, and an amorphous silicon surface layer 703, wherein the photosensitive layer 702 is formed of amorphous hydrogenated silicon or amorphous halogenated silicon (a-Si:H,X) and has photoconductivity property.

Figure 8C:
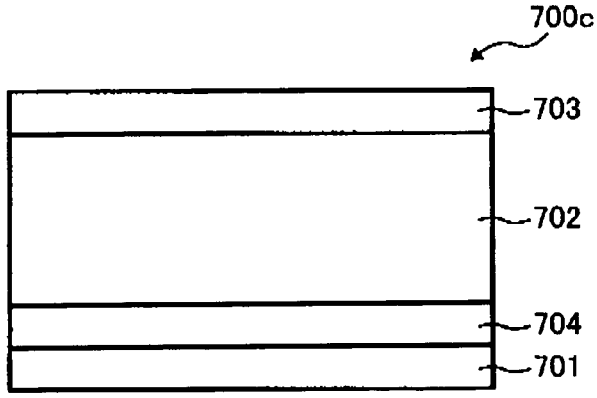

FIG. 8C shows a photosensitive member 700*c*, which includes the support member 701, the photosensitive layer 702, the amorphous silicon surface layer 703, and a charge blocking layer 704, wherein the photosensitive layer 702 is formed of amorphous hydrogenated silicon or amorphous halogenated silicon (a-Si:H,X) and has photoconductivity property.

Figure 8D:
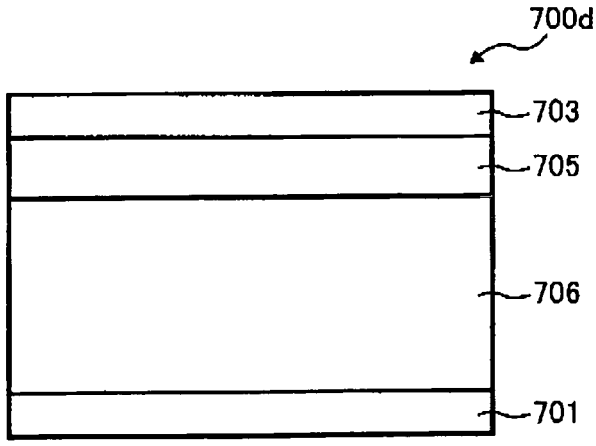

FIG. 8D shows a photosensitive member 700*d*, which includes the support member 701, the amorphous silicon surface layer 703, a charge generating layer 705, and a charge transport layer 706, wherein each of the charge generating layer 705 and charge transport layer 706 is formed of amorphous hydrogenated silicon or amorphous halogenated silicon (a-Si:H,X). The charge generating layer 705, mainly composed of charge generating material, and the charge transport layer 706, mainly composed of charge transport material, are layered on the support member 701.

Furthermore, a filler material can be included in the photosensitive layer 702 and the charge transport layer 706 to improve mechanical strength.

Figure 9:
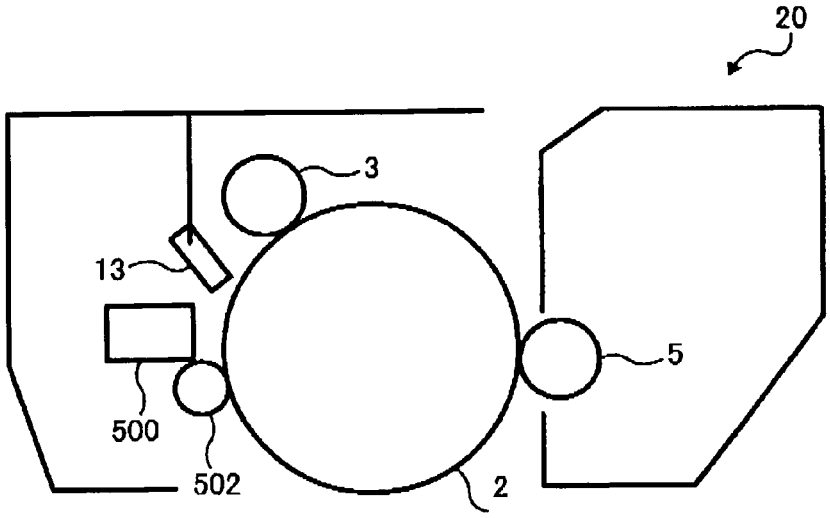
FIG. 9 is a schematic view explaining a configuration of a process cartridge according to one example embodiment.

FIG. 9 is a schematic view explaining a configuration of a process cartridge 20 according to one example embodiment.

As shown in FIG. 9, the process cartridge 20 includes the photosensitive member 2, the charging unit 3, the developing unit 5, the cleaning unit 13, the solid-type lubricant 500, and the fur brush 502.

The process cartridge 20 combines a plurality of above-mentioned units integrally, and the process cartridge 20 can be detachably provided to an image forming apparatus such as copier and printer.

Hereinafter, a lubricant applying process according to one example embodiment is explained with reference to FIG. 10 and using zinc stearate as lubricant.

Figure 10:
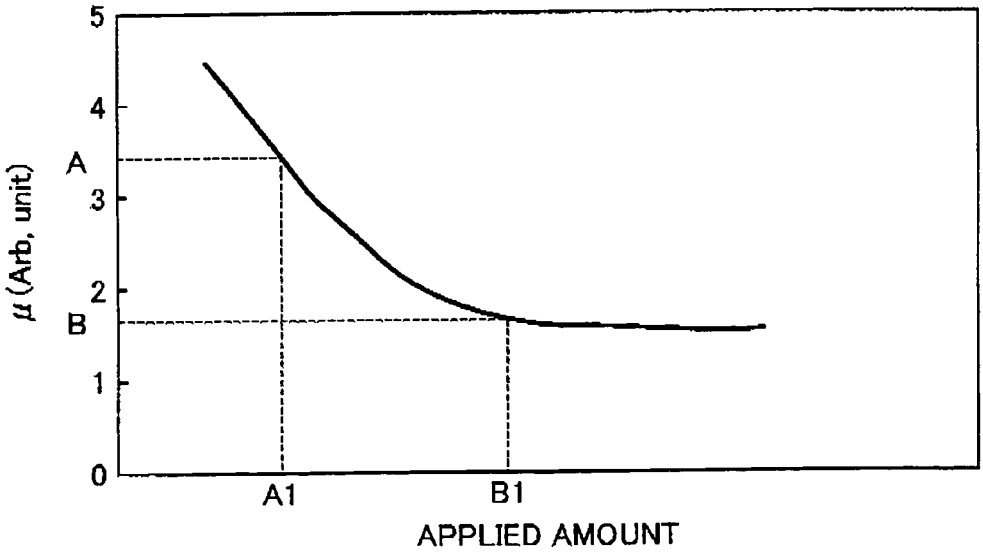
FIG. 10 is a graph explaining a relationship between applying amount of zinc stearate and friction coefficient of a photosensitive member.

FIG. 10 is a graph showing a relationship of applying amount of lubricant (e.g., zinc stearate) and g of the photosensitive member, wherein the "μ" is a friction coefficient having arbitrary unit (Arb, unit).

Point A in the graph shows a maximum limit of μ, from which the photosensitive member can be cleaned effectively. If the μ becomes too large, cleaning-ability of the photosensitive member may deteriorate.

Point B in the graph shows a saturation limit of μ, from which the friction coefficient of the photosensitive member becomes substantially stable. Therefore, the friction coefficient of the photosensitive member may not be lowered even if an applying amount of zinc stearate is increased once the "μ" reaches the saturation limit.

Therefore, when the photosensitive member includes a charge transport layer (CTL) made of polycarbonate, the "μ" becomes at the maximum limit or saturation limit by applying the following amount of A1 or B1 of zinc stearate, respectively.

$$A1=1.2\times10^{-7}\ \text{g/cm}^2 \text{ for point } A, \text{ and}$$

$$B1=1.3\times10^{-6}\ \text{g/cm}^2 \text{ for point } B.$$

Accordingly, the A1 and B1 becomes a minimum and maximum limit of the applying amount, respectively.

In the above-mentioned charging method according to one example embodiment, a voltage having a DC component and a superimposed AC component is applied, and fatty acid metal salt may be used as lubricant.

In this case, the metal element percentage EP (%) of the fatty acid metal salt, which exists on a surface of the photosensitive member, can be detected by using X-ray photoelectron spectroscopy (XPS).

If such metal element percentage EP (%) satisfies the following formula, the lubricant applied on the photosensitive member can effectively exert its protective function.

$$EP \geqq 1.52\times10^{-4}\times(Vpp-2\times Vth)\times(f/V)\ (\%)$$

wherein "Vpp" is an voltage amplitude of the AC component applied to the charge device, "f" is frequency (Hz) of the AC component applied to the charge device, "V" is moving speed (mm/sec) of the surface of the photosensitive member, and "Vth" is a discharge initiation voltage.

The Vth can be defined with the following formula.

$$Vth=312+6.2\times(d/\epsilon opc+Gp/\epsilon\text{air})+\sqrt{(7737.6\times d/\epsilon)}$$

wherein "d" (μm) is a layer thickness of the to-be-charged portion of the photosensitive member, "Gp" is a minimum distance (μm) between the surface of the charge device and the surface of the photosensitive member, "εopc" is a relative dielectric constant of to-be-charged portion of the photosensitive member (e.g., organic photo conductor), and "εair" is a relative dielectric constant of space between the to-be-charged portion of the photosensitive member and the charge device.

In XPS measurement, zinc stearate is applied on a sample plate of organic photo conductor (OPC) placed on a sample holder, and a measurement was conducted by using X-ray photoelectron spectroscopy 1600S of Physical Electronics Industries Inc (PHI).

The measurement condition includes an X-ray source of MgKa having a power of 100W, and an analysis area of 0.8 mm×2.0 mm.

Surface atom concentration was evaluated from peak value for each of measured elements to determine metal element percentage "EP" of zinc stearate on the organic photo conductor.

With such measurement, "EP" (%) which optimizes the lubricant applying amount was determined. With such preferable EP, the lubricant can effectively exert its protection function.

Once a preferable EP is determined, metal element percentage "EP" (%) can be quantitatively controlled using the above-mentioned parameters used in the above-mentioned formula.

Although the lubricant applying amount can also be quantitatively controlled based on a covering ratio of the lubricant (e.g., zinc stearate) on the photosensitive layer, which can be observed by macroscopic observation method, the lubricant applying amount can be controlled more precisely with the above-described method using XPS.

Figure 11:
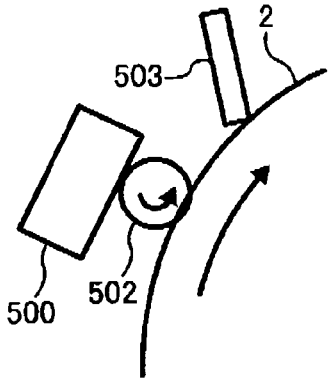
FIG. 11 is a schematic view of a lubricant applying unit according to one example embodiment.

FIG. 11 is a schematic view of a lubricant applying unit according to one example embodiment.

As shown in FIG. 11, the solid-type lubricant 500 is applied to the photosensitive member 2 via the rotating fur brush 502.

The fur brush 502 contacts the solid-type lubricant 500 and partially scrapes the solid-type lubricant 500.

The scraped solid-type lubricant 500 adheres to the fur brush 502, and is then applied to the photosensitive member 2.

The applied lubricant is leveled on the photosensitive member 2 by a blade 503, which is an elastic member. The blade 503 preferably contacts the photosensitive member with a line pressure of 25 to 105 g/cm, for example.

In FIG. 11, the blade 503 is a counter blade but the blade 503 can also include a trailing blade. The blade 503 preferably has a JIS A hardness of 55 to 80°, for example.

Furthermore, the fur brush 502 can be used as a cleaning brush, and the blade 503 can be used as a cleaning blade, as required.

The solid-type lubricant 500 includes higher fatty acid metal salt such as zinc stearate, for example.

Zinc stearate, which is a typical lamellae crystal powder, is preferably used as lubricant.

The lamellae crystal has a layered structure, in which the amphipathic molecules are self-organized, thereby crystals easily break up along the layer and consequently slide easily when a shearing force is applied to the crystal. Such property of lamellae crystals is effective to lower the friction coefficient.

With receiving a shearing force, the lamellae crystal of lubricant breaks up along the layer, whereby the surface of the photosensitive member can be covered uniformly with a relatively small amount of lubricant.

In addition to an effect of giving smoothness, the lubricant such as solid-type lubricant can reduce deterioration of the photosensitive member due to charging, whereby the lubricant can be also used as a protection material for the photosensitive member.

As shown in FIG. 3, when the charge device, closely disposed or in contact with the photosensitive member 2, conducts discharging with the photosensitive member 2 to charge the photosensitive member 2, the surface of the photosensitive member 2 is more likely to deteriorate, whereby the lubricant can be effectively used as a protection material.

As above-described, the metal element percentage EP(%) in the fatty acid metal salt on the surface of the to-be-charged portion of the photosensitive member can be defined as below by XPS measurement.

$$EP \geqq 1.52\times10^{-4}\times(Vpp-2\times Vth)\times(f/V)\ (\%)$$

If the lubricant is applied to the photosensitive member so as to satisfy the above relationship, the lubricant can be effectively used as a protection material.

Figure 12:
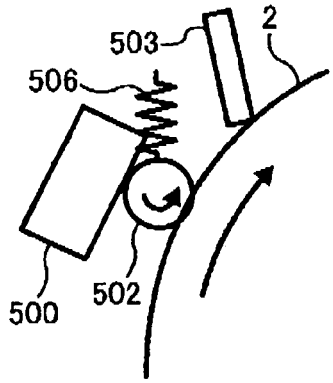
FIG. 12 is a schematic view of another lubricant applying unit according to one example embodiment, in which a solenoid is provided to control lubricant applying amount.

FIG. 12 is a schematic view of another lubricant applying unit according to one example embodiment, in which a solenoid is provided to control lubricant applying amount.

As shown in FIG. 12, the solid-type lubricant 500 is applied to the photosensitive member 2 via the rotating fur brush 502, in which the fur brush 502 is controlled by a solenoid 506.

The solenoid 506 can control the timing when to contact the fur brush 502 to the photosensitive member 2, and rotating times of the fur brush 502. With such controlling, lubricant amount to be applied on the photosensitive member 2 can be controlled.

After applying the lubricant to the photosensitive member 2 by the fur brush 502, the lubricant can be leveled off by conducting a plurality of leveling operations by the blade 503. With such leveling operations, the lubricant applying amount to the photosensitive member 2 can be reduced while effectively applying the lubricant on the photosensitive member 2.

Furthermore, the blade 503 (i.e., leveling member) can be controlled in a manner that the blade 503 contacts the photosensitive member 2 when such contact is required. With such controlling, a curling of blade 503, which may happen when the lubricant applying amount on the photosensitive member 2 is not sufficient, can be prevented.

Although the lubricant is applied with a blade in the above-described example embodiments, lubricant can be applied with any other desired method and should not be considered as limited to the use of a blade.

In example embodiments, a lubricant such as a fatty acid metal salt is applied to the photosensitive member 2 so that lubricant concentration level per unit area is maintained within a range of $1.2\times10^{-7}$ g/cm$^2$ to $1.3\times10^{-6}$ g/cm$^2$, for example.

Therefore, as long as the above-mentioned lubricant concentration range of $1.2\times10^{-7}$ g/cm$^2$ to $1.3\times10^{-6}$ g/cm$^2$ can be secured, any type of lubricant applying member and leveling member can be used.

Figure 13:
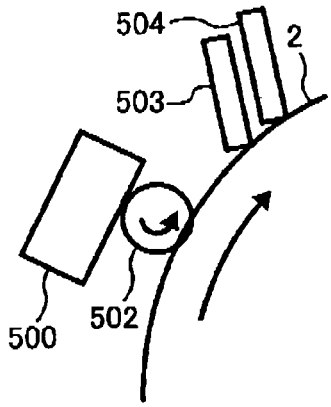
FIG. 13 is a schematic view of another lubricant applying unit according to one example embodiment, in which a plurality of blades are provided.

FIG. 13 is a schematic view of another lubricant applying unit according to one example embodiment, in which a plurality of blades are provided.

As shown in FIG. 13, the solid-type lubricant 500 is applied to the photosensitive member 2 via the rotating fur brush 502, and a plurality of blades (blades 503 and 504 )) are provided as leveling members. The blades 503 and 504 blade 503 preferably contact the photosensitive member with a line pressure of 25 to 105 g/cm, for example. The blades 503 and 504 preferably have a JIS A hardness of 55 to 80°, for example.

With such a configuration, a lubricant layer can be formed on the photosensitive member 2 with a relatively shorter time while securing a predetermined amount of lubricant on the photosensitive member 2.

Although the lubricant is leveled with the blade in the above-described example embodiments, lubricant can be leveled with non-limiting methods.

Figure 14:
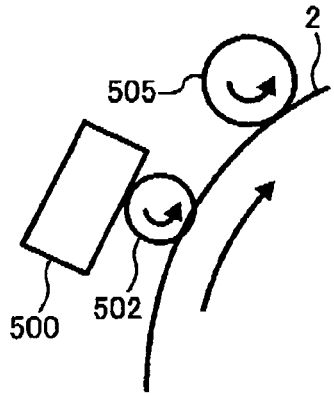
FIG. 14 is a schematic view of another lubricant applying unit according to one example embodiment, in which a rubber roller is provided instead of a blade.

FIG. 14 is a schematic view of another lubricant applying unit according to one example embodiment, in which a rubber roller is provided instead of blade.

As shown in FIG. 14, the solid-type lubricant 500 is applied to the photosensitive member 2 via the rotating fur brush 502, and a rubber roller 505 is provided as a leveling member instead of blade. The rubber roller 505 can be made of resin such as urethane rubber, for example.

Figure 15:
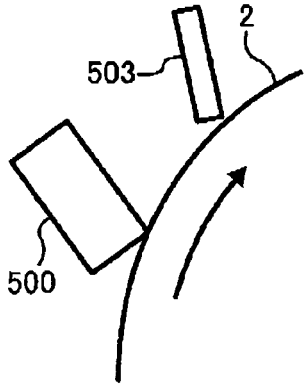
FIG. 15 is a schematic view of another lubricant applying unit according to one example embodiment, in which solid-type lubricant directly contacts a photosensitive member.

FIG. 15 is a schematic view of another lubricant applying unit according to one example embodiment, in which the solid-type lubricant 500 directly contacts the photosensitive member 2. As shown in FIG. 15, the solid-type lubricant 500 can be directly applied to the photosensitive member 2, and a configuration shown in FIG. 15 can conduct a similar effect as in the configurations shown in FIGS. 11 to 14.

Accordingly, a configuration shown in FIG. 15 can reduce the number of components and manufacturing cost.

As for the leveling member, an intermediate transfer belt or an intermediate transfer drum can also be used.

For example, in FIG. 2, the lubricant is applied to the photosensitive member 2 via the fur brush 502, and such lubricant can be leveled by the intermediate transfer belt 61.

With such a leveling operation, a lubricant layer having a predetermined applying amount can be formed on the photosensitive member 2. Such a configuration can also reduce the number of components and manufacturing cost.

Although not shown, if an image forming apparatus includes a transport belt, which contacts the image carrying member 2 to receive a toner image on a recording medium transported by the transport belt, such transport belt can also be used as the leveling member to level off the lubricant on the image carrying member.

Furthermore, in the configurations shown in FIG. 11 to 15, the lubricant applying speed can be controlled during the image forming process.

Discharging between the charging roller 3 and the photosensitive member 2 is influenced by environment conditions such as temperature and humidity changing over time.

By monitoring the discharge intensity, the lubricant applying speed can be controlled to a preferable level based on the detected discharge intensity, wherein the discharge intensity can be determined by a value of discharge electric current to be applied to the charging roller 3.

Thereby the lubricant applying amount to the photosensitive member 2 can be adjusted based on the detected discharge intensity (i.e., discharge electric current), and consequently lubricant application can be conducted in a stable manner.

A central processing unit (CPU), which controls the lubricant applying amount, can store information such as relationship of discharge electric current and applying speed, whereby the CPU can control the lubricant applying amount to the photosensitive member at a preferable level based on the stored information if the environmental conditions have changed.

Figure 16:
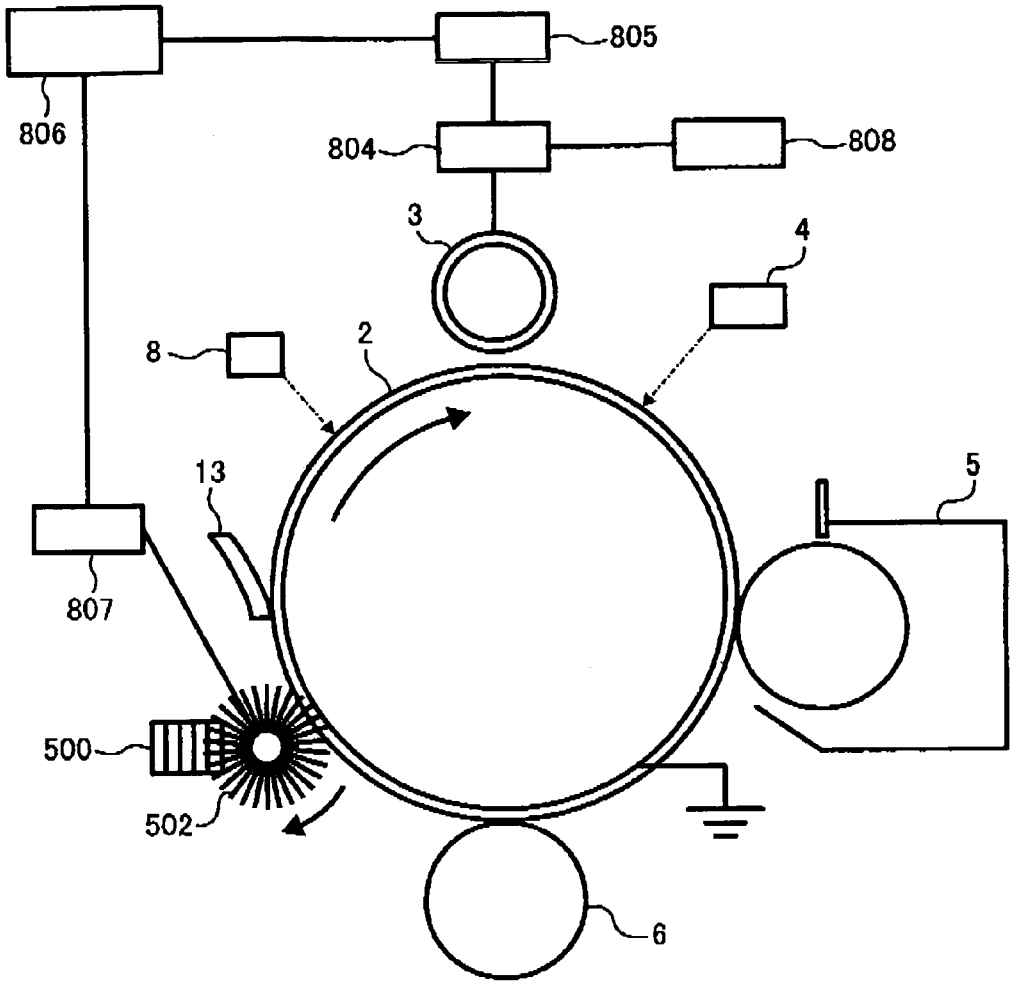
FIG. 16 is a schematic view explaining a configuration of lubricant applying unit according to one example embodiment, in which a brush rotating controller changes rotating speed of a brush to control lubricant applying speed.

For example, FIG. 16 is a schematic view explaining a configuration of the lubricant applying unit according to one example embodiment, in which a brush rotating controller changes rotating speed of a brush to control lubricant applying speed.

As shown in FIG. 16, a power source 808, a voltage applying unit 804, and a current measurement unit 805 are connected to the charging roller 3 to supply current to the charging roller 3.

As shown in FIG. 16, a CPU 806 stores information such as the relationship of discharge electric current and preferable applying speed.

Based on detected discharge electric current, the CPU 806 instructs a brush rotating controller 807 to change a rotating speed of the fur brush 502 so that the lubricant applying speed can be controlled.

Furthermore, by monitoring the intensity of discharge light generated between the charging roller 3 and the photosensitive member 2, the lubricant applying speed can be controlled to preferable levels.

With providing such a controlling scheme, the lubricant can be applied to the photosensitive member in a preferable amount if the charge condition has changed due to a change of environmental conditions.

The above-mentioned controlling scheme can be used in the configurations shown in FIGS. 1 to 16.

In the example embodiments, the image forming apparatus can employ toners, which may have a circularity of 0.96 or greater.

FIGS. 18A to 18D shows polyarylate resins used for a photosensitive member, but other resins can be used, as required.

In order to provide properties which are effective to anti-abrasiveness and image distortion, the resins have a weight-average molecular weight of 7,500 to 37,000, and preferably have a weight-average molecular weight of 10,000 to 37,000, and more preferably have a weight-average molecular weight of 15,000 to 30,000, for example.

Image distortion is a phenomenon that printed lines such as black line show a defective appearance on a printed sheet. Specifically, such printed lines have lower concentration than adequately printed lines, have blurring on the lines, or lower concentration and blurring at the same time. Such image distortion is more likely to happen if environmental conditions become severe such as higher temperature and higher humidity.

Furthermore, in order to secure properties which are effective to mechanical and electrical strength and image distortion, the resins preferably have a polydispersity of 3.0 or less, and more preferably have a polydispersity of 2.6 or less, for example.

The "polydispersity" is a value which is obtained by dividing the weight-average molecular weight by the number average molecular weight.

"polydispersity"=(weight average molecular weight)/(number average molecular weight)

Hereinafter, types of photosensitive member and amount of lubricant on the photosensitive member are explained, wherein the lubricant employs zinc stearate, for example.

By changing the amount of zinc stearate on the photosensitive member, surface conditions of the photosensitive member and cleaning-ability were evaluated as below.

The cleaning-ability means a level of toners remaining on the photosensitive member after transferring the toner image.

Hereinafter, experiment conditions are explained.

Experiment Conditions

Image forming apparatus: a modified "IPSiO color 8100" full-color printer using a direct transfer method (a product of Ricoh Company, Ltd.).

Photosensitive member: a drum type having a top surface layer, made of polyarylate resin and having a thickness of 5 μm. As for the polyarylate resin, No. (1) structure shown in FIG. 18A was used.

Charge unit: a charging roller which is a hard type and non-contact type shown in FIGS. 3 and 4.

Bias voltage applied to charge unit: AC component: Vpp=3.0 kV, f=1.35 kHz, DC component: −600V (Vpp=3.0 kV is greater than a design voltage used for ordinary operations, thereby properties of the photosensitive member are more likely to be changed.)

Number of sheets to be printed: 10,000 (A4 size)

Lubricant application method: Lubricant was applied with a configuration shown in FIG. 14, and a spring was used to bias the lubricant to the fur brush. Such biasing pressure to the fur brush was changed from 0 mN to 1,200 mN with a step of 100 mN to adjust the lubricant applying amount to the photosensitive member.

Fur brush: Approximately 1 mm of the brush substantially overlap with a surface of the image photosensitive member.

Cleaning blade: a urethane blade having a JIS A hardness of 70. The cleaning blade contacts the photosensitive member with a line pressure of 25 to 105 g/cm.

Rotating speed of photosensitive member: 185 mm/sec

Table 1 shows the result of the experiment.

The experiment was evaluated in two points: cleaning deficiency of the photosensitive member and stains on the charging roller.

The cleaning deficiency means a phenomenon that toners that sneaked through a contact area of the photosensitive member and the cleaning blade form a stripe or band shape. Such sneaked toners may unfavorably appear on recording sheets.

The stains on the charging roller means a phenomenon in which a tiny amount of toners sneak through a contact area of the photosensitive member and the cleaning blade. Such tiny amount of toners itself may not affect image quality on recording sheets. However, a part of the tiny amount of toners may adhere to the charging roller of the charge unit.

If the charge unit conducts charging using AC component, and the amount of toners adhered to the charging roller is too small, image quality on recording sheets may not deteriorate.

However, if the amount of toners adhered to the charging roller is too large, the charging roller may not uniformly charge the photosensitive member, whereby a charging unevenness may happen on the photosensitive member, and may result in degradation of the image quality on recording sheets.

As shown in Nos. 1 to 4 of Table 1, cleaning deficiency was observed when the lubricant applying amount was relatively small.

In cases of Nos. 1 to 4 of Table 1, it was observed that remaining toners sneaked on the photosensitive member in a stripe shape.

Furthermore, it was observed that the surface of the photosensitive member was oxidized based on a surface analysis.

Such chemical changes on the surface of the photosensitive member may induce an adhesion of toners on the photosensitive member, or a propagation of surface irregularities locally, and consequently may lower the cleaning-ability of the photosensitive member.

In cases of Nos. 1 to 4 of Table 1, the photosensitive member was abraded. And the cleaning blade was abraded at its edge portion which contacts the photosensitive member.

As shown in Nos. 5 to 9 of Table 1, when the lubricant applying amount was within a preferable range, no cleaning deficiency and no oxidization of the surface of the photosensitive member was observed.

As shown in Nos. 10 to 13 of Table 1, when the lubricant applying amount was relatively large, stains on the charging roller were observed.

In cases of Nos. 10 to 13 of Table 1, it was observed that a tiny amount of toners sneaked through the cleaning blade. However, such tiny amount of toners may not affect the image quality.

In general, the polyarylate resin has good cleaning-ability. Therefore, the photosensitive member having the polyarylate resin in its surface layer may show good cleaning-ability by applying the lubricant on the photosensitive member.

However, the above-mentioned stains happened on the charging roller because an excess amount of lubricant on the photosensitive member may prevent good cleaning-ability of the polyarylate resin.

In cases of Nos. 10 to 13 of Table 1, the photosensitive member was not abraded. And the cleaning blade was not abraded at its edge portion which contacts the photosensitive member. Therefore, the lubricant may effectively exert its lubrication function.

From the surface analysis, when polyarylate resin is used to form a surface layer of the photosensitive member, it was found that a lubricant is preferably applied on the surface layer of the photosensitive member with an amount of $1.2\times10^{-7}$ g/cm$^2$ to $0.9\times10^{-6}$ g/cm$^2$ per unit area of the surface layer of the photosensitive member.

When the lubricant is applied to the photosensitive member with a biasing pressure shown in No. 5 of Table 1, the lubricant amount applied on the surface of image forming apparatus substantially becomes $1.2\times10^{-7}$ g/cm$^2$ per unit area of the surface of the photosensitive member, and such amount corresponds to the Point A1 in FIG. 10.

When the lubricant is applied to the photosensitive member with a biasing pressure shown in No. 9 of Table 1, the lubricant amount applied on the surface of image forming apparatus substantially becomes $0.9\times10^{-6}$ g/cm$^2$ per unit area of the surface of the photosensitive member, and such amount corresponds to the Point B1 in FIG. 10.

It was found that a friction coefficient corresponding to the Point A1 (i.e., No. 5 in Table 1) becomes a maximum limit for effective cleaning-ability. If the friction coefficient becomes larger than the maximum limit, the cleaning-ability may be deteriorated significantly.

It was also found that a friction coefficient corresponding to the Point B1 (i.e., No. 9 in Table 1) becomes a saturation limit (minimum limit) for effective cleaning-ability. As shown in FIG. 10, the friction coefficient becomes substantially stable even if the lubricant applying amount becomes larger than the amount at the Point B1.

Therefore, as shown in Nos. 1 to 4 of Table 1, if the lubricant applying amount was relatively small and the friction coefficient becomes larger than the maximum limit, cleaning deficiency was observed, and as shown in Nos. 10 to 13 of Table 1, if the lubricant applying amount was too excessive, stains on the charging roller were observed.

Nos. 14 to 26 of Table 1 show results of experiments using polycarbonate resin for forming a surface layer of the photosensitive member.

As shown in Nos. 14 to 19 of Table 1, when the lubricant applying amount on the surface layer of the photosensitive member made of polycarbonate resin is relatively small, cleaning deficiency happened as in the polyarylate resin.

Discharging may change chemical properties of polycarbonate resin as similar to polyarylate resin, whereby such cleaning deficiency may happen.

Furthermore, cleaning-ability of the photosensitive member formed of polycarbonate resin may deteriorate significantly when chemical properties of polycarbonate resin change by discharging.

This may be due to a relatively smaller cleaning-ability of polycarbonate resin compared to polyarylate resin.

In case of Nos. 20 to 23 of Table 1, cleaning deficiency was not observed, and oxidization of the photosensitive member was also not observed. However, a tiny stain was observed on the charging roller.

Compared to polyarylate resin, polycarbonate resin may have a lower cleaning-ability, whereby toners may sneak through a cleaning member such as cleaning blade and such toners may be observed as stains on the charging roller.

In cases of Nos. 24 to 26 of Table 1, stains observed on the charging roller became more significant than No. 20 to 23. In cases of Nos. 24 to 26, an amount of toners sneaked through a cleaning member such as cleaning blade became larger than No. 5.

In cases of Nos. 24 to 26, lubricant may be applied on the photosensitive member excessively, and such excessively applied lubricant may lower cleaning-ability of the photosensitive member, and such lower cleaning-ability may result in an increase of sneaked toners.

As above described, when lubricant is applied to a surface of photosensitive member, a photosensitive member having polyarylate resin on its surface portion has a stable cleaning-ability, whereby an image forming apparatus can be operated stably.

The support member 701 having electroconductivity can be made as below.

For example, electroconductive material such as metal (e.g., aluminum, nickel, chromium, nichromium, copper, gold, silver and platinum) or metal oxide (e.g., tin oxide and indium oxide) having volume resistivity of 1,010 Ω·cm or less is coated on a base member such as plastic film, plastic cylinder and paper by vapor deposition or sputtering to form the support member 701.

Or, a metal plate (e.g., aluminum, aluminum alloy, nickel, and stainless steel) formed in tube shape by conducting processes such as extrusion and drawing can be treated with a surface treatment such as machining, super finishing, polishing to form the support member 701.

Or an endless nickel belt, or endless stainless steel belt can be used as the support member 701.

Furthermore, the support member 701 can be made by coating electroconductive powder dispersed in a binding resin on the above-mentioned base member.

The electroconductive powder includes carbon black, acetylene black, metal powder (e.g., aluminum, nickel, iron, nichromium, copper, zinc, and silver), and metal oxide powder (e.g., electro-conductive tin oxide), for example.

The binding resin, used with the electroconductive powder, includes thermoplastic resin, thermosetting resin and photo-curing resin such as polystyrene, styrene-acrylonitrile copolymer, styrene-butadiene copolymer, styrene-maleic anhydride copolymer, polyester, polyvinyl chloride, vinyl chloride vinyl acetate copolymer, polyvinyl acetate, polyvinylidene chloride, polyarylate resin, phenoxy resin, polycarbonate, acetylcellulose resin, ethyl cellulose resin, polyvinylbutyral, polyvinyl formal, polyvinyl toluene, poly-N-vinyl carbazole, acrylic resin, silicone resin, epoxy resin, melamine resin, urethane resin, phenolic resin, and alkyd resin, for example.

Such electroconductive powder and binding resin are dispersed in a solvent such as tetrahydrofuran, dichloromethane, methyl ethyl ketone, and toluene, for example, and such dispersed solution is applied to the base member to form an electroconductive layer.

Furthermore, a heat shrinkable tube, having the above mentioned electro-conductive powder and materials such as polyvinyl chloride, polypropylene, polyester, polystyrene, polyvinylidene chloride, polyethylene, chlorinated rubber, and Teflon (registered trademark), can be provided on a cylinder-shaped base member to form the support member 701.

In example embodiments, a photosensitive member includes a single layer type and a layered type, wherein the single layer type disperses charge generating material in a charge transport layer, and the layered type stacks a charge generating layer and a charge transport layer.

Hereinafter, a photosensitive member of the layered type which stacks the charge generating layer 705 and the charge transport layer 706 is explained.

The charge generating layer 705 is mainly composed of charge generating material, and includes binding resin, as required.

The charge generating material includes inorganic material and organic material.

The inorganic material includes crystal selenium, amorphous selenium, selenium tellurium, selenium tellurium halogen, selenium arsenic compound, and amorphous silicon, for example.

As for the amorphous silicon, amorphous silicon having a dangling bond terminated by hydrogen atom or halogen atom, and amorphous silicon doped with boron atom or phosphorus atom can be preferably used.

The organic material includes publicly-known materials such as phthalocyanine pigment (e.g., metal phthalocyanine, non-metal phthalocyanine), azulenium salt pigment, squaric acid methine pigment, azo pigment having carbazole structure, azo pigment having triphenyl amine structure, azo pigment having diphenylamine structure, azo pigment having dibenzothiophene structure, azo pigment having fluorenone structure, azo pigment having oxadiazole structure, azo pigment having bisstilbene structure, azo pigment having distyryl oxadiazole, azo pigment having distyryl carbazole structure, perylene pigment, anthraquinone or polycyclic-quinone pigment, quinonimine pigment, diphenylmethane or triphenylmethane pigment, benzoquinone or naphthoquinone pigment, cyanine or azomethine pigment, indigoid pigment, and bisbenzimidazole pigment, for example.

The charge generating layer can be formed with one specific material of the above-mentioned materials or with a mixture of the above-mentioned materials.

The charge generating layer can include binding resin such as polyamide, polyurethane, epoxy resin, polyketone, polycarbonate, polyarylate, silicone resin, acrylic resin, polyvinylbutyral, polyvinyl formal, polyvinyl ketone, polystyrene, poly-N-vinyl carbazole, and polyacrylamide, for example.

The charge generating layer can include one specific binding resin of the above-mentioned binding resins or a mixture of the above-mentioned binding resins.

The charge generating layer can include binding resin such as polymer charge transport material, and low molecular charge transport material, as required.

The charge generating layer can include charge transport material such as electron transport material and hole transport material.

Each of the electron transport material and hole transport material further includes low molecular charge transport material and polymer charge transport material.

The electron transport material includes electron-accepting material such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno [1,2-b] thiophene-4-on, and 1,3,7-trinitrodibenzothiophene-5,5-dioxide, for example.

The electron transport material can be one specific material of the above-mentioned materials or a mixture of the above-mentioned materials.

The hole transport material includes electron-donating material such as oxazole derivatives, oxadiazole derivatives, imidazole derivatives, triphenyl amine derivatives, 9-(p-diethylaminostyrylanthracene), 1,1-bis (4-dibenzylaminophenyl) propane, styrylanthracene, styrylpyrazoline, phenylhydrazone, α-phenylstilbene derivatives, thiazole derivatives, triazole derivatives, phenazine derivatives, acridine derivatives, benzofuran derivatives, benzimidazole derivatives, and thiophene derivatives, for example.

The hole transport material can be one specific material of the above-mentioned materials or a mixture of the above-mentioned materials.

The polymer charge transport material includes polymers such as polymer having carbazole ring (e.g., poly-N-vinyl carbazole), polymer having hydrazone structure, polysilyl polymer, and polymer having triaryl amines structure for example.

The polymer charge transport material can be one specific material of the above-mentioned materials or a mixture of the above-mentioned materials.

The charge generating layer 705 mainly includes charge generating material, solvent and binding resin, and can also include additives such as sensitizer, dispersing agent, surfactant, and silicone oil.

Methods of forming a charge generating layer include thin film preparation techniques and casting process using dispersed solution, for example.

The thin film preparation techniques include vacuum deposition method, grow discharge decomposition method, ion plating method, sputtering method, reactive sputtering method, and chemical vapor deposition (CVD) method, for example. With such methods, the above-mentioned inorganic material and organic material can be favorably formed.

The casting process used for forming the charge generating layer 705 is conducted as below.

At first, the above-mentioned inorganic or organic charge generating material is dispersed in a solvent such as tetrahydrofuran, cyclohexanone, dioxane, dichloroethane, butanone using a ball mill, attritor, sand mill or the like. A binding resin may also be dispersed with the charge generating material, if required. Such dispersed solution is properly diluted, and applied to form the charge generating layer 705.

Such application can be conducted by dip coating, spray coating, bead coating, or the like.

The charge generating layer prepared by such methods has a layer thickness of 0.01 to 5 μm, and preferably has a layer thickness of 0.05 to 2 μm.

Hereinafter, the charge transport layer 706 is explained.

The charge transport layer 706 can be formed as below. At first, a mixture or copolymer of the charge transporting material and the binder resin is dissolved and dispersed in a solvent, and then such dispersed solution is applied and dried to form the charge transport layer 706.

The charge transport layer 706 prepared by such method has a layer thickness of 10 to 100 μm, and preferably has a layer thickness of 10 to 30 μm when a higher resolution is in need.

In a case that the charge transport layer becomes an outermost layer, polymer compounds which can be used as binding resin include polyarylate, copolymerized polyarylate and charge transport material, and a mixture of polyarylate and other polymer compound.

Such other polymer compound includes thermoplastic resin or thermosetting resin such as polystyrene, styrene-acrylonitrile copolymer, styrene-butadiene copolymer, styrene-maleic anhydride copolymer, polyester, polyvinyl chloride, vinyl chloride/vinyl acetate copolymer, polyvinyl acetate, polyvinylidene chloride, polycarbonate, acetylcellulose resin, ethyl cellulose resin, polyvinylbutyral, polyvinyl formal, polyvinyl toluene, acrylic resin, silicone resin, fluorine resin, epoxy resin, melamine resin, urethane resin, phenolic resin, and alkyd resin, for example, but not limited to the above-mentioned materials.

The charge transport material includes the above-mentioned low molecular electron transport material, hole transport material, and polymer charge transport material, for example.

When a low molecular charge transport material is used, approximately 20 to 200 parts by weight of the low molecular charge transport material is used with approximately 100 parts by weight of the polymer compound, and preferably approximately 50 to 100 parts by weight of the low molecular charge transport material is used with approximately 100 parts by weight of the polymer compound.

When a polymer charge transport material is used, approximately 0 to 500 parts by weight of the resin component is preferably used with approximately 100 parts by weight of the charge transport material to form copolymers.

The solvent, used for dispersing charge transport material, includes ketones (e.g., methyl ethyl ketone, acetone, methyl isobutyl ketone, cyclohexanone), ethers (e.g., dioxane, tetrahydrofuran, ethylcellosolve), aromatics (e.g., toluene, xylene), halogens (e.g., chlorobenzene, dichloromethane), and esters (e.g., ethyl acetate, butyl acetate), for example.

Furthermore, the charge transport layer 706 can include an organic or inorganic filler material in a surface portion of the charge transport layer to improve abrasion resistance.

The organic filler material includes fluorine resin powder (e.g., polytetrafluoroethylene), silicone resin powder, and amorphous carbon powder, for example.

The inorganic filler material includes metal powder (e.g., copper, tin, aluminum, indium), metal oxide (e.g., silica, tin oxide, zinc oxide, titanium oxide, alumina, indium oxide, antimony oxide, bismuth oxide, calcium oxide, tin oxide doped with antimony, indium oxide doped with tin), metal fluoride (e.g., stannous fluoride, calcium, aluminum fluoride), and inorganic material (e.g., potassium titanate, boron nitride), for example.

From the viewpoint of the hardness of filler material, inorganic filler material is favorable to improve abrasion resistance. Specifically, silica, titanium oxide, or alumina can be effective.

The filler material can be one material of the above-mentioned filler materials or a mixture of the above-mentioned filler materials.

The surface of a filler material may be modified by a surface treatment agent to improve disperse-ability of the filler material in a coating solution and coated layer.

The filler material can be dispersed with the charge transport material, binding resin, and solvent using a dispersing apparatus.

The filler material preferably has an average particle diameter of 0.01 to 0.8 μm from the viewpoint of transmissivity of the charge transport layer and abrasion resistance.

The filler material can be uniformly dispersed in the charge transport layer 706. However, it is preferable to disperse the filler material by changing its concentration in the charge transport layer 706 as below, for example, because a higher voltage may be biased on an exposing area.

For example, the filler material concentration can be decreased in a direction from an outer-surface side of the charge transport layer 706 to a support member side of the charge transport layer 706, or the charge transport layer 706 may be consisted of a plurality of layers and the filler material concentration can be changed in each layer so that the filler material concentration is decreased in a direction from an outer-surface side of the charge transport layer 706 to a support member side of the charge transport layer 706.

The thickness (i.e., depth from surface) of the inorganic filler material layer in the charge transport layer 706 is preferably 0.5 μm or greater, and more preferably from 2 μm or greater.

In a case that the charge transport layer becomes an outermost layer in example embodiments, binding resin which can be used in charge transport layer includes polyarylate, copolymerized polyarylate and charge transport material, or a mixture of polyarylate and other polymer compound.

The charge transport material includes the above-mentioned low molecular electron transport material, hole transport material, and polymer charge transport material.

Furthermore, the charge transport layer 706 can include antioxidant, plasticizer, lubricant, ultraviolet absorber, low molecular compound (e.g., low molecular charge transport material), and leveling agent, as required.

The charge transport layer 706 can include one such material or a mixture of such materials.

When the low molecular compound is used, approximately 0.1 to 200 parts by weight of the low molecular compound is used with approximately 100 parts by weight of the polymer compound, and 0.1 to 30 parts by weight of the low molecular compound is preferably used with approximately 100 parts by weight of the polymer compound.

When the leveling agent is used, approximately 0.001 to 5 parts by weight of the leveling agent is used with approximately 100 parts by weight of the polymer compound.

Hereinafter, the photosensitive layer 702 of single layer type is explained.

Such photosensitive layer 702 can be formed as below. At first, a mixture of the charge generating material, charge transporting material, and binder resin is dissolved and dispersed in a solvent, and then such dispersed solution is applied and dried to form the photosensitive layer 702 of single layer type.

The photosensitive layer 702 can include plasticizer, leveling agent, and antioxidant, as required.

The binding resin, used in the photosensitive layer 702, includes polyarylate, copolymerized polyarylate and charge transport material, or a mixture of polyarylate and other polymer compound.

Furthermore, such binding resin can be mixed with a binding resin, which is exemplified for the charge generating layer 705.

As for the charge generating material, approximately 5 to 40 parts by weight of the charge generating material is preferably used with approximately 100 parts by weight of the binding resin.

As for the charge transport material, approximately 0 to 190 parts by weight of the charge transport material is preferably used with approximately 100 parts by weight of the binding resin, and more preferably approximately 50 to 150 parts by weight of the charge transport material is preferably used with approximately 100 parts by weight of the binding resin.

The photosensitive layer 702 can be formed as below. At first, the above-mentioned charge generating material, charge transport material, and binding resin are dispersed in a solvent such as tetrahydrofuran, dioxane, dichloroethane, and cyclohexane using a dispersing apparatus (e.g., ball mill, attritor, sand mill). Such dispersed solution is diluted, and applied to form the photosensitive layer 702.

Such application can be conducted by dip coating, spray coating, bead coating, or the like.

The photosensitive layer 702 prepared by such methods preferably has a layer thickness of 5 to 25 μm.

When the photosensitive layer 702 becomes an outermost layer, the photosensitive layer 702 can include filler material to improve mechanical strength of the photosensitive layer 702.

As similar to the above-described charge transport layer 706, the filler material can be uniformly dispersed in the photosensitive layer 702. However, it is also effective to disperse filler material by changing its concentration in the photosensitive layer 702 as below.

For example, the filler material concentration can be decreased in a direction from an outer-surface side of the photosensitive layer 702 to a support member side of the photosensitive layer 702, or the photosensitive layer 702 may be consisted of a plurality of layers and the filler material concentration can be changed in each layer so that the filler material concentration is decreased in a direction from an outer-surface side of the photosensitive layer 702 to a support member side of the photosensitive layer 702.

Furthermore, in example embodiments, the photosensitive member 2 can include an intermediate layer (not shown) between the support member 701 and the photosensitive layer 702.

Such intermediate layer mainly includes resin. Such resin preferably has anti-solvency to organic solvents because the photosensitive layer 702 is formed on the intermediate layer (not shown) by applying a solution having organic solvent on the intermediate layer (not shown).

Such resin includes water-soluble resin (e.g., polyvinyl alcohol, casein, sodium polyacrylate), alcohol-soluble resin (e.g., copolymer nylon, methoxymethyl nylon), curable resin (e.g., polyurethane, melamine resin, phenolic resin, alkyd melamine resin, epoxy resin).

The intermediate layer can include fine powder pigments such as metal oxide (e.g., titanium oxide, silica, alumina, zirconium oxide, tin oxide, indium oxide) to prevent moire phenomenon and to reduce residual potential.

The intermediate layer can be formed with a coating method using a solvent similar to the above-mentioned photosensitive layer 702.

Furthermore, the intermediate layer can be formed by using silane coupling agent, titanate coupling agent, chromium coupling agent, or the like.

Furthermore, the intermediate layer can be favorably formed by anodic oxidation of $Al_2O_3$, or by thin film preparation techniques using organic material such as poly-para-xylylene (parylene) or inorganic material such as $SiO_2$, $SnO_2$, $TiO_2$, ITO, and $CeO_2$.

The intermediate layer has a thickness of 0 to 20 μm, and preferably has a thickness of 1 to 10 μm.

In example embodiments, each layer such as charge generating layer, charge transport layer, intermediate layer, protection layer can include additives such as antioxidant, plasticizer, lubricant, ultraviolet absorber, low molecular charge transport material, and leveling agent to improve robustness to environmental conditions such as lower sensitivity and increase of residual potential. Hereinafter, typical materials are listed as below.

As below mentioned, each layer can include, but is not limited to, the following antioxidant.

(a) Phenol-based Compounds 2,6-di-t-butyl-p-cresol, butyl hydroxyanisole, 2,6-di-t-butyl-4-ethylphenol, n-octadecyl-3-(4'-hydroxy-3',5'-di-t-butyl-phenol), 2,2'-methylene-bis(4-methyl-6-t-butyl-phenol), 2,2'-methylene-bis(4-ethyl-6-t-butyl-phenol), 4,4'-thiobis-(3-methyl-6-t-butyl-phenol), 4,4'-butylidene-bis(3-methyl-6-t-butyl-phenol), 1,1,3-tris-(2-methyl-4-hydroxy-5-t-butyl-phenyl) butane, 1,3,5-trimethyl-2,4,6-tris-(3,5-di-t-butyl-4-hydroxybenzyl)benzene, tetrakis-(methylene-3-(3',5'-di-t-butyl-4'-hydroxyphenyl)propionate)methane, bis(3,3'-bis(4'-hydroxy-3'-t-butyl-phenyl)butyric acid)glycolester, tocopherol.

(b) Para Phenylenediamines

N-phenyl-N'-isopropyl-p-phenylenediamine, N,N'-di-/sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine.

(c) Hydroquinones 2,5-di-t-octylhydroquinone, 2,6-didodecylhydroquinone, 2-dodecylhydroquinone, 2-dodecyl-5-chlorohydroquinone, 2-t-octyl-5-methyl-hydroquinone, 2-(2-octadecenyl)-5-methyl-hydroquinone.

(d) Organic Sulfur Compounds

Dilauryl-3,3'-thiodipropionate, distearyl-3,3'-thiodipropionate, ditetradecyl-3,3'-thiodipropionate.

(e) Organic Phosphorus Compounds

Triphenylphosphine, tri(nonylphenyl) phosphine, tri(dinonylphenyl) phosphine, tricresyl phosphine, tri(2,4-dibutylphenoxy) phosphine.

As below mentioned, each layer can include, but is not limited to, the following plasticizer.

(a) Phosphoric Ester-based Plasticizers

Triphenyl phosphate, tricresyl phosphate, trioctyl phosphate, octyl diphenyl phosphate, trichlorethyl phosphate, cresyldiphenyl phosphate, tributyl phosphate, tri-2-ethylhexyl phosphate.

(b) Phthalate Ester Plasticizers

Dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, fumaric acid dibutyl, fumaric acid dioctyl.

(c) Aromatic Carboxylic Acid Ester Plasticizers

Trioctyl trimellitic acid, tri-n-octyl trimellitic acid, oxybenzoic acid octyl.

(d) Aliphatic Dibasic Acid Ester Plasticizer

Dibutyl adipate, di-n-hexyl adipate, di-2-ethylhexyl adipate, di-n-octyl adipate, n-octyl-n-decyl adipate, adipate diisodecyl, dicapryl adipate, di-2-ethylhexyl azelaic acid, dimethyl sebacic acid, diethyl sebacic acid, dibutyl sebacic acid, di-n-octyl sebacic acid, di-2-ethylhexyl sebacic acid, sebacic acid di-2-ethoxyethyl, dioctyl succinic acid, diisodecyl succinic acid, dioctyl tetrahydrophthalate, di-n-octyl tetrahydrophthalate.

(e) Fatty Acid Ester Derivatives butyl oleate, glycerinmono oleate, acetylricinoleic acid methyl, pentaerythritol ester, dipentaerythritolhexaester, triacetin, tributyrin.

(f) Hydroxy Acid Ester Plasticizers

Acetylricinoleic acid methyl, acetylricinoleic acid butyl, butylphthalyl butylglycolate, acetylcitric acid tributyl.

(g) Epoxy Plasticizers

Epoxy soybean oil, epoxy linseed oil, epoxy stearic acid butyl, epoxy stearic acid decyl, epoxy stearic acid octyl, epoxy stearic acid benzyl, epoxy hexahydro phthalate dioctyl, epoxy hexahydro phthalate didecyl.

(h) Hihydric Alcohol Ester Plasticizers

Diethylene glycol dibenzoate, triethylene glycol di-2-ethyl butyrate.

(i) Chlorinated Plasticizers

Chlorinated paraffin, chlorinated diphenyl, chlorinated fatty acid methyl, methoxy chlorinated fatty acid methyl.

(j) Polyester Plasticizers

Polypropylene adipate, polypropylene sebacate, polyester, acetyl polyester.

(k) Sulfonic Acid Derivatives p-toluene sulfonamide, o-toluene sulfonamide, p-toluene sulfonic ethyl amide, o-toluene sulfonic ethyl amide, toluene sulfon-N-ethyl amide, p-toluene sulfone-N-cyclohexyl amide.

(i) Citric Acid Derivatives

Triethyl citric acid citrate, acetylcitric acid triethyl, citrate tributyl, acetylcitric acid tributyl, acetylcitric acid tri-2-ethylhexyl, acetylcitric acid-n-octyl-decyl.

(m) Others

Terphenyl, partially hydrogenated terphenyl, camphor, 2-nitro diphenyl, dinonyl naphthalene, abietic acid methyl.

As below mentioned, each layer can include, but is not limited to, the following lubricant.

(a) Hydrocarbon Compounds

Liquid paraffin, paraffin wax, micro wax, oligomer polyethylene.

(b) Fatty Acid Compounds

Lauric acid, myristic acid, palmitic acid, stearic acid, arachidic acid, behenic acid.

(c) Fatty Acid Amide Compounds

Stearyl amide, palmityl amide, olein amide, methylene bis stearamide, ethylene bis stearamide.

(d) Ester Compounds

Lower alcohol ester of fatty acid, polyalcohol ester of fatty acid, fatty acid polyglycol ester.

(e) Alcohol Compounds

Cetyl alcohol, stearyl alcohol, ethyleneglycol, polyethylene glycol, polyglycerol.

(f) Metallic Soaps

Lead stearate, cadmium stearate, barium stearate, calcium stearate, zinc stearate, magnesium stearate, iron stearate, lithium stearate.

(g) Natural Waxes

Calnauba wax, candelilla wax, bees wax, whale wax, insect wax, montan wax.

(h) Others silicone compound, fluorine compound.

As below mentioned, each layer can include, but is not limited to, the following ultraviolet absorber.

(a) Benzophenones 2-hydroxy-benzophenone, 2,4-dihydroxy-benzophenone, 2,2',4-trihydroxy-benzophenone, 2,2',4,4'-tetrahydroxy-benzophenone, 2,2'-dihydroxy-4-methoxybenzophenone.

(b) Salicylates

Phenyl salicylate, 2,4di-t-butyl-phenyl3,5-di-t-butyl-4hydroxy-benzoate.

(c) Benzotriazoles (2'-hydroxy-phenyl) benzotriazole, (2'-hydroxy-5'-methyl-phenyl) benzotriazole, (2'-hydroxy-5'-methyl-phenyl) benzotriazole, (2'-hydroxy-3'-tertiarybutyl-5'-methyl-phenyl) 5-chlorobenzotriazole.

(d) Cyanoacrylates

Ethyl-2-cyano-3,3-diphenyl acrylate, methyl-2-carbomethoxy-3 (p-methoxy) acrylate.

(e) Quenchers (Metallic Complex Salt)

Nickel (2,2'thiobis(4-t-octyl)phenolate)n-butyl-amine, nickel dibutyl-dithiocarbamate, nickel dibutyl-dithiocarbamate, cobalt dicyclohexyl dithio phosphate.

(f) Hindered Amine Light Stabilizers (HALS)

Bis(2,2,6,6-tetramethyl-4-piperidyl)sebacate, bis(1,2,2,6,6-pentamethyl-4-piperidyl)sebacate, 1-(2-[3-(3,5-di-t-butyl-4-hydroxy-phenyl)propionyloxy]ethyl)-4-[3-(3,5-di-t-butyl-4-hydroxy-phenyl)propionyloxy]-2,2,6,6-tetramethyl-pyridine, 8-benzyl-7,7,9,9-tetramethyl-3-octyl-1,3,8-triazaspiro[4,5]undecane-2,4-dione, 4-benzoyloxy 2,2,6,6-tetramethyl-piperidine.

TABLE 1

| No. | Surface layer Material | Biasing Pressure applied to Lubricant | Result |
|---|---|---|---|
| 1 | Polyarylate | 0 mN | Cleaning deficiency |
| 2 | Resin | 100 mN | Cleaning deficiency |
| 3 | | 200 mN | Cleaning deficiency |
| 4 | | 300 mN | Cleaning deficiency |
| 5 | | 400 mN | No cleaning deficiency |
| 6 | | 500 mN | No cleaning deficiency |
| 7 | | 600 mN | No cleaning deficiency |
| 8 | | 700 mN | No cleaning deficiency |
| 9 | | 800 mN | No cleaning deficiency |
| 10 | | 900 mN | Stain on charge roller |
| 11 | | 1000 mN | Stain on charge roller |
| 12 | | 1100 mN | Stain on charge roller |
| 13 | | 1200 mN | Stain on charge roller |
| 14 | Polycarbonate | 0 mN | Cleaning deficiency |
| 15 | resin | 100 mN | Cleaning deficiency |
| 16 | | 200 mN | Cleaning deficiency |
| 17 | | 300 mN | Cleaning deficiency |
| 18 | | 400 mN | Cleaning deficiency |
| 19 | | 500 mN | Cleaning deficiency |
| 20 | | 600 mN | A little stain on charge roller |
| 21 | | 700 mN | A little stain on charge roller |
| 22 | | 800 mN | A little stain on charge roller |
| 23 | | 900 mN | A little stain on charge roller |
| 24 | | 1000 mN | Stain on charge roller |
| 25 | | 1100 mN | Stain on charge roller |
| 26 | | 1200 mN | Stain on charge roller |

Numerous additional modifications and variations are possible in light of the above teachings. It is therefore to be understood that within the scope of the appended claims, the disclosure of the present invention may be practiced otherwise than as specifically described herein.

This application claims priority from Japanese patent applications No. 2004-312097 filed on Oct. 27, 2004, No. 2005-040420 filed on Feb. 17, 2005, and No. 2005-159781 filed on May 31, 2005, in the Japan Patent Office, the entire contents of which are hereby incorporated by reference herein.

What is claimed is:

1. A lubricant applying unit for use in an image forming apparatus having a photosensitive member and a charge device, comprising:

a lubricant applying member configured to apply lubricant on a surface of the photosensitive member; and a leveling member configured to level off the lubricant applied on the surface of the photosensitive member, wherein the charge device is configured to apply a bias voltage, having direct current voltage and alternating current voltage superimposed to the direct current voltage, to the photosensitive member, and a metal element percentage EP(%) of the lubricant on the photosensitive member, measured by X-ray photoelectron spectroscopy after applying the lubricant, satisfies a relationship of $$EP \geqq 1.52\times10^{-4}\times(Vpp-2\times Vth)\times(f/v),$$

wherein Vpp is a voltage amplitude of an alternating current component applied to the charge device, f is frequency (Hz) of the alternating current component applied to the charge device, v is a moving speed (mm/see) of the surface of the photosensitive member, and Vth is a discharge initiation voltage defined by a formula of $$Vth=312+6.2\times(d/\epsilon opc+Gpp/\epsilon air)+\sqrt{(7737.6\times d/\epsilon)}$$

wherein d(μm) is a layer thickness of a to-be-charged portion of the photosensitive member, Gpp is a minimum distance (μm) between a surface of the charge device and a surface of the photosensitive member, εopc is a relative dielectric constant of the photosensitive member, and εair is a relative dielectric constant of space between the charge device and the photosensitive member.

2. The lubricant applying unit of claim 1, wherein the lubricant applying unit applies the lubricant in an amount of $1.2\times10^{-7}$ g/cm$^2$ to $1.3\times10^{-6}$ g/cm$^2$ per unit area of the photosensitive member.

3. The lubricant applying unit according to claim 1, wherein the charge device and the photosensitive member are configured to have a space gap of 5 to 100 μm therebetween to conduct an indirect discharging to the photosensitive member.

4. The lubricant applying unit according to claim 1, wherein the lubricant comprises a fatty acid metal salt.

5. The lubricant applying unit according to claim 4, wherein the fatty acid metal salt comprises at least one fatty acid selected from the group consisting of stearic acid, palmitic acid, myristic acid, and oleic acid, and at least one metal selected from the group consisting of zinc, aluminum, calcium, magnesium, iron, and lithium.

6. The lubricant applying unit according to claim 4, wherein the fatty acid metal salt comprises zinc stearate.

7. The lubricant applying unit according to claim 4, wherein the fatty acid metal salt is shaped in solid form.

8. The lubricant applying unit according to claim 7, wherein the solid form of the fatty acid metal is formed by solidifying powders of the fatty acid metal salt.

9. The lubricant applying unit according to claim 1, wherein the lubricant applying member comprises a fur brush configured to apply the lubricant on the surface of the photosensitive member.

10. The image forming apparatus according to claim 1, wherein the leveling member comprises an elastic member formed in blade shape.

11. The image forming apparatus according to claim 10, wherein the elastic member has a JIS A hardness of 55 to 80°.

12. The image forming apparatus according to claim 10, wherein the elastic member is configured to contact the photosensitive member with a line pressure of 25 to 105 g/cm.

13. The lubricant applying unit according to claim 1, wherein the leveling member is additionally configured to clean the photosensitive member.

14. The lubricant applying unit according to claim 1, further comprising an intermediate transfer member, configured to contact the photosensitive member to receive a toner image from the photosensitive member thereon, and is additionally configured to level off the lubricant on the photosensitive member.

15. The lubricant applying unit according to claim 14, wherein the intermediate transfer member comprises any one of a transfer belt and a transfer drum.

16. The lubricant applying unit according to claim 1, further comprising a transport belt, configured to contact the photosensitive member to receive a toner image on a recording medium transported by the transport belt, and is additionally configured to level off the lubricant on the photosensitive member.

17. The lubricant applying unit according to claim 1, wherein the image forming apparatus uses toners having circularity of 0.96 or greater.

18. The lubricant applying unit according to claim 1, wherein the photosensitive member comprises a charge generating layer comprising amorphous silicon.

19. An image forming apparatus comprising the lubricant applying unit of claim 1.

20. A lubricant applying unit for use in an image forming apparatus having a photosensitive member and a charge device, comprising:

a lubricant applying member configured to apply lubricant on a surface of the photosensitive member; and a leveling member configured to level off the lubricant applied on the surface of the photosensitive member, wherein the lubricant applying unit applies the lubricant in an amount of $1.2\times10^{-7}$ g/cm$^2$ to $1.3\times10^{-6}$ g/cm$^2$ per unit area of the photosensitive member;

wherein the charge device is configured to apply a bias voltage, having direct current voltage and alternating current voltage superimposed to the direct current voltage, to the photosensitive member, and a metal element percentage EP(%) of the lubricant on the photosensitive member, measured by X-ray photoelectron spectroscopy after applying the lubricant, satisfies a relationship of $$EP \geqq 1.52\times10^{-4}\times(Vpp-2\times Vth)\times(f/v),$$

wherein Vpp is a voltage amplitude of an alternating current component applied to the charge device, f is frequency (Hz) of the alternating current component applied to the charge device, v is a moving speed (mm/sec) of the surface of the photosensitive member, and Vth is a discharge initiation voltage defined by a formula of $$Vth=312+6.2\times(d/\epsilon opc+Gpp/\epsilon air)+\sqrt{(7737.6\times d/\epsilon)}$$

wherein d(μm) is a layer thickness of a to-be-charged portion of the photosensitive member, Gpp is a minimum distance (μm) between a surface of the charge device and a surface of the photosensitive member, ϵopc is a relative dielectric constant of the photosensitive member, and ϵair is a relative dielectric constant of space between the charge device and the photosensitive member.

21. An image forming apparatus comprising the lubricant applying unit of claim 20.

* * * * *